US010463943B2

(12) United States Patent
Markison

(10) Patent No.: US 10,463,943 B2
(45) Date of Patent: Nov. 5, 2019

(54) MODULAR BULLPEN MOUND WITH REPLACEABLE TRAYS

(71) Applicant: Athalonz, LLC, Mesa, AZ (US)

(72) Inventor: Timothy W. Markison, Mesa, AZ (US)

(73) Assignee: Athalonz, LLC, Mesa, AZ (US)

( * ) Notice: Subject to any disclaimer, the term of this patent is extended or adjusted under 35 U.S.C. 154(b) by 0 days.

(21) Appl. No.: 16/238,918

(22) Filed: Jan. 3, 2019

(65) Prior Publication Data

US 2019/0134485 A1 May 9, 2019

Related U.S. Application Data

(63) Continuation of application No. 15/201,531, filed on Jul. 4, 2016, now Pat. No. 10,173,123, which is a continuation-in-part of application No. 14/506,299, filed on Oct. 3, 2014, now Pat. No. 9,381,419, which is a continuation of application No. 13/593,360, filed on Aug. 23, 2012, now Pat. No. 8,882,615.

(51) Int. Cl.

| | |
|---|---|
| ***A63B 71/00*** | (2006.01) |
| ***A63B 71/02*** | (2006.01) |
| ***A63B 69/00*** | (2006.01) |
| *A63B 102/18* | (2015.01) |

(52) U.S. Cl.

CPC ..... *A63B 71/02* (2013.01); *A63B 69/0002* (2013.01); *A63B 71/00* (2013.01); *A63B 2069/0006* (2013.01); *A63B 2102/18* (2015.10); *A63B 2102/182* (2015.10); *A63B 2210/50* (2013.01)

(58) Field of Classification Search

CPC ..... A63B 69/0002; A63B 69/0013; A63B 2069/0006; A63B 2069/0002; A63B 71/02; A63B 71/00; A63B 2102/18; A63B 2102/182; A63B 2210/50

USPC ..... 473/497, 451, 422, 452, 499

See application file for complete search history.

(56) References Cited

U.S. PATENT DOCUMENTS

| | | | | |
|---|---|---|---|---|
| 4,749,223 A | | 6/1988 | Goeders | |
| 5,058,889 A | | 10/1991 | Burton | |
| 5,467,977 A | * | 11/1995 | Beck | A63B 69/0013 473/497 |
| 5,707,305 A | | 1/1998 | Goeders et al. | |
| 5,716,295 A | * | 2/1998 | Anglea | A63C 19/06 473/497 |
| 6,139,450 A | * | 10/2000 | Rivers | A63B 69/0002 473/422 |

(Continued)

OTHER PUBLICATIONS

Sportsfield Specialties; Porta-Pitch Portable Pitchers Mound: [downloaded from Internet Aug. 23, 2012; http://www.sportsfieldspecialties.com]; 2 pgs.

*Primary Examiner* — Mitra Aryanpour

(74) *Attorney, Agent, or Firm* — Garlick & Markison; Timothy W. Markison

(57) ABSTRACT

A bullpen mound includes a first mound section, a second mound section, and bridge section that couples to the first and second mound sections. Each of the first and second mound sections includes a base piece, an H-piece, a nose piece, a drive tray, and a landing tray. The base piece and the H-piece, when coupled together, form a first drive tray receptacle for receiving the drive tray. The H-piece and the nose piece, when coupled together, form a first landing tray opening for receiving the landing tray.

6 Claims, 38 Drawing Sheets

(56) References Cited

U.S. PATENT DOCUMENTS

| | | | | |
|---|---|---|---|---|
| 6,843,739 | B2 * | 1/2005 | Putnam | A63B 69/0002 473/451 |
| 6,945,883 | B1 * | 9/2005 | Williams | A63B 69/0002 473/422 |
| 7,344,459 | B2 | 3/2008 | Bykowsky | |
| 7,621,831 | B2 * | 11/2009 | Roberts | A63B 69/0002 473/497 |
| 8,047,934 | B2 | 11/2011 | Goeders | |
| 8,157,678 | B2 | 4/2012 | Goeders | |
| 8,251,843 | B1 | 8/2012 | Goeders | |
| 8,882,615 | B2 | 11/2014 | Adair et al. | |
| 9,381,419 | B2 | 7/2016 | Adair et al. | |
| 2007/0111828 | A1 | 5/2007 | Goeders | |
| 2007/0298915 | A1 | 12/2007 | Goeders | |
| 2009/0233740 | A1 * | 9/2009 | Gensler | A63B 69/0002 473/497 |
| 2011/0143869 | A1 | 6/2011 | Goeders | |
| 2013/0196797 | A1 | 8/2013 | Lee et al. | |
| 2013/0345000 | A1 * | 12/2013 | Gangwer | A63B 69/0002 473/497 |
| 2014/0057745 | A1 | 2/2014 | Adair et al. | |
| 2015/0024878 | A1 * | 1/2015 | Adair | A63B 69/0002 473/497 |
| 2016/0271479 | A1 * | 9/2016 | Lee | A63B 71/02 473/497 |
| 2016/0296822 | A1 * | 10/2016 | Semerano | A63B 69/0002 473/497 |
| 2016/0310818 | A1 | 10/2016 | Markison | |

* cited by examiner

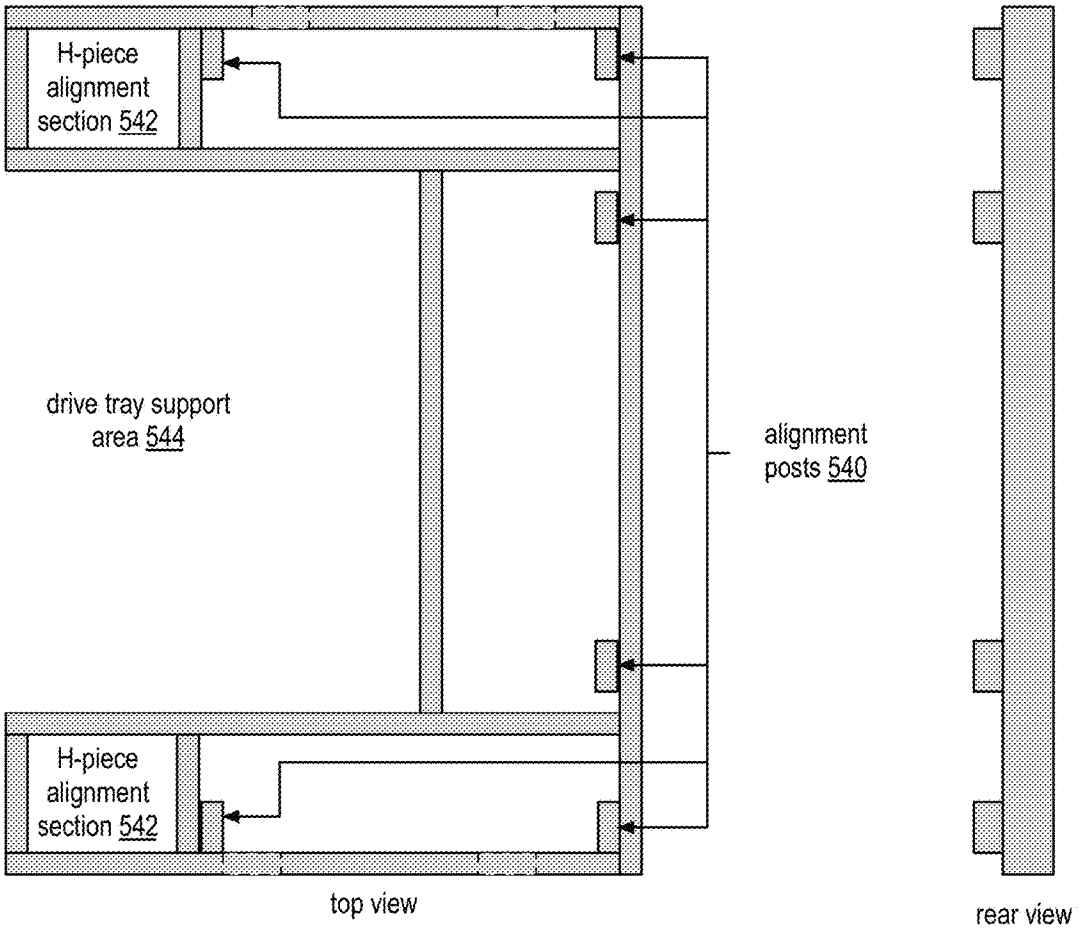
FIG. 2B
FIG. 2A
lower base outer frame 510-1
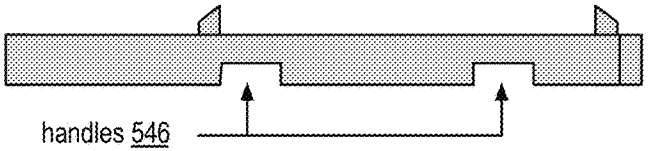
side view
FIG. 2C rear view top view upper base
frame 513

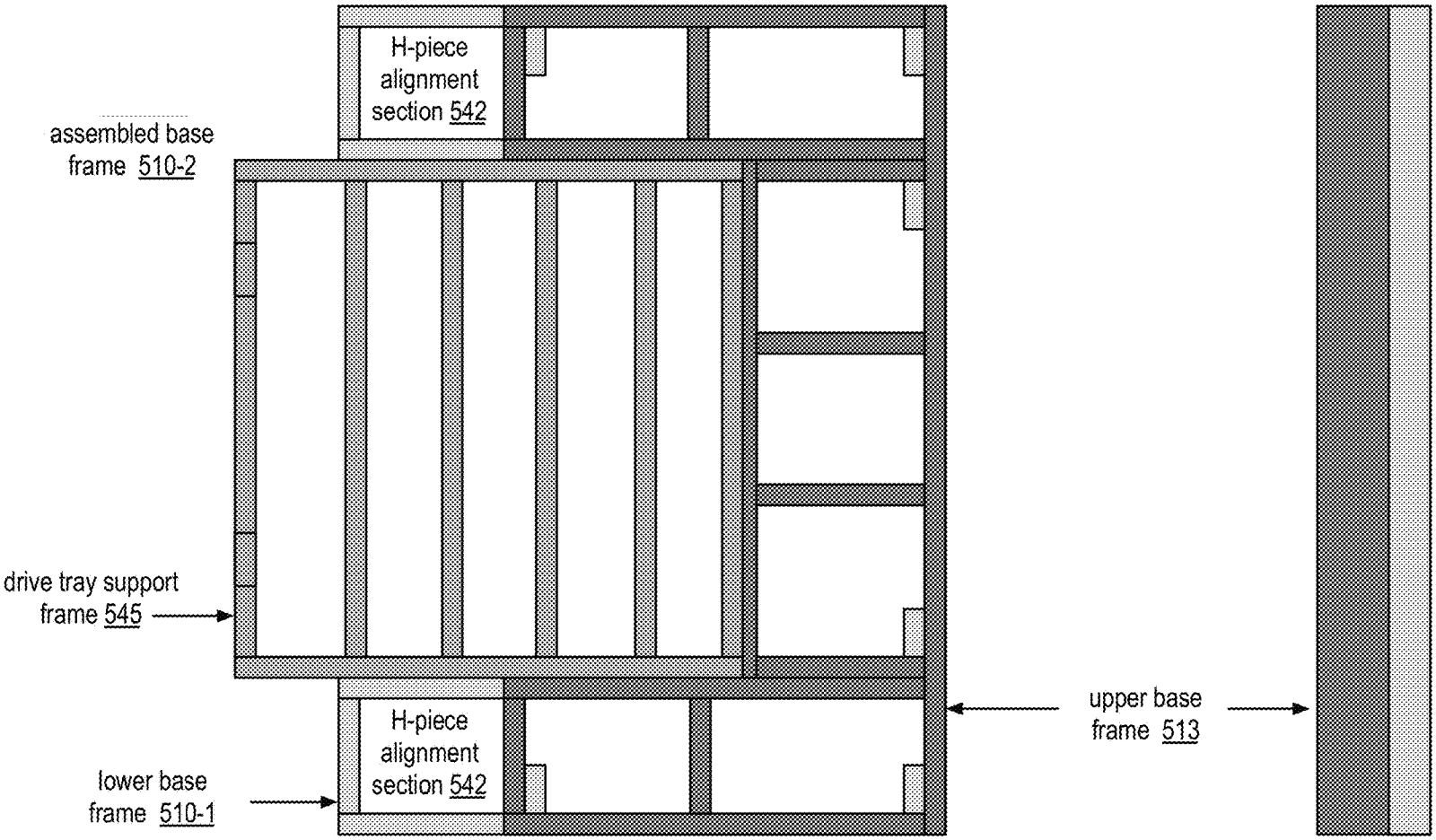
top view FIG. 2I
rear view FIG. 2J rear view top view

H-piece frame 518-1 top view side view

H-piece frame 518-2

H-piece frame 518-4 top view nose piece frame 520-1 side view rear view right front piece coupling 557 left front piece coupling 559 landing tray receptacle area 554-1 top view nose piece frame 520-2

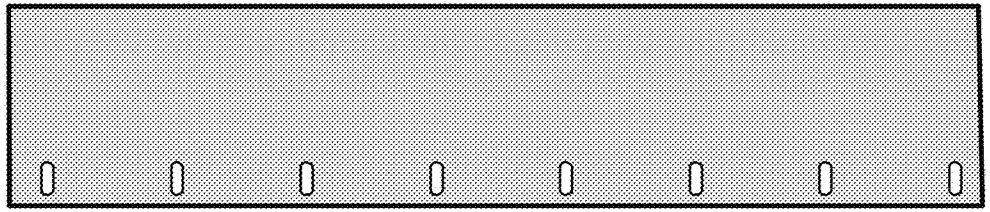
bottom view
FIG. 3P
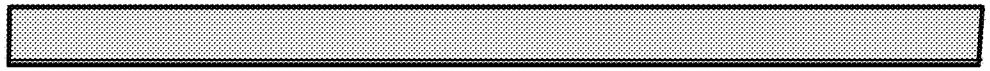
rear view
FIG. 3O
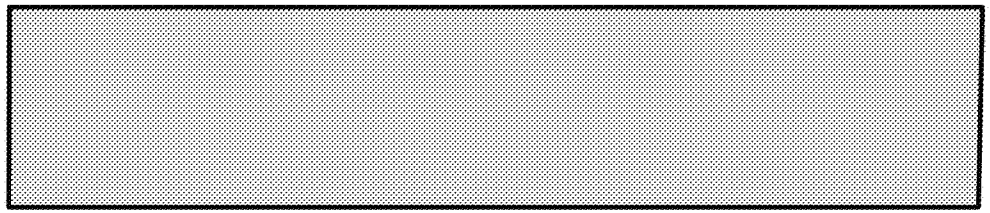
top view
FIG. 3N
nose cap 522-1
FIG. 3Q
side view
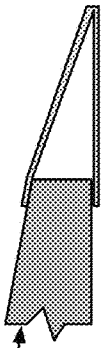
nose piece 520
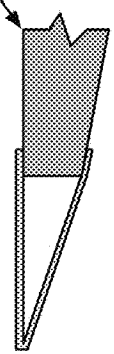
side view
FIG. 3R left nose cap
522-3 right nose cap
522-2

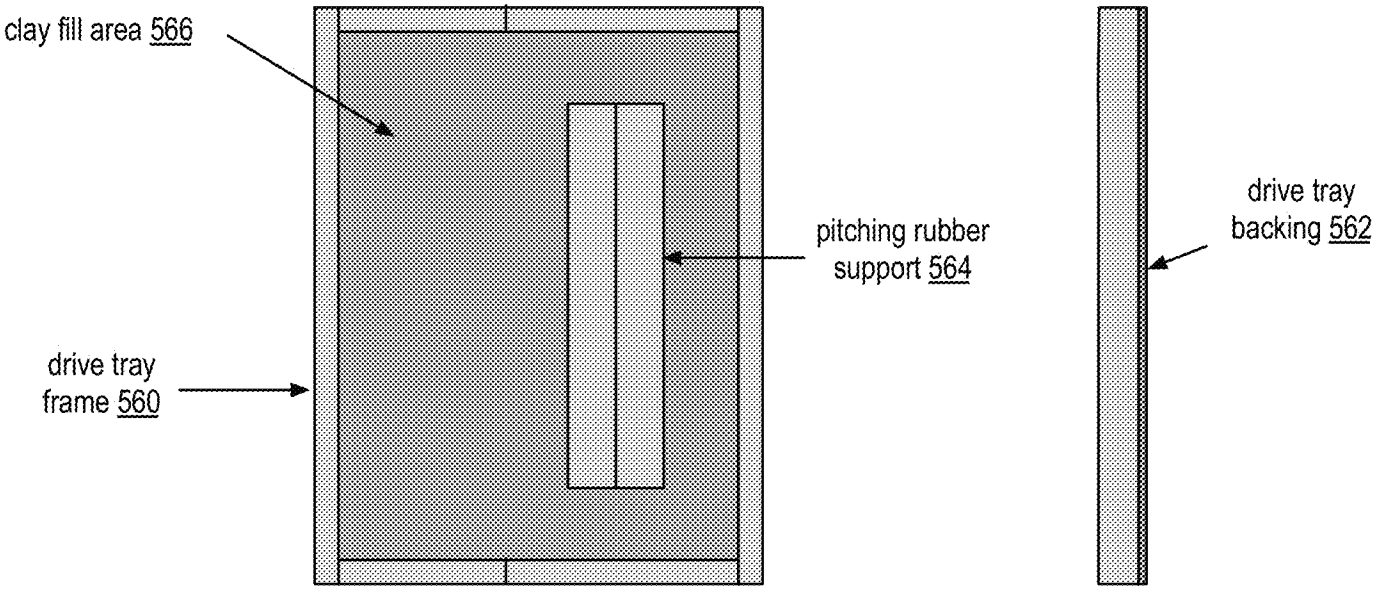
FIG. 4A
top view
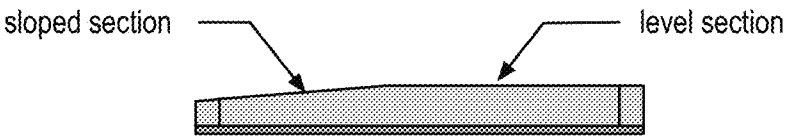
FIG. 4B
side view
FIG. 4C
rear view
drive tray 524-1 rear view top view side view drive tray
524-2 rear view top view side view rear view top view side view rear view top view landing tray 526-1 side view landing tray 526-2

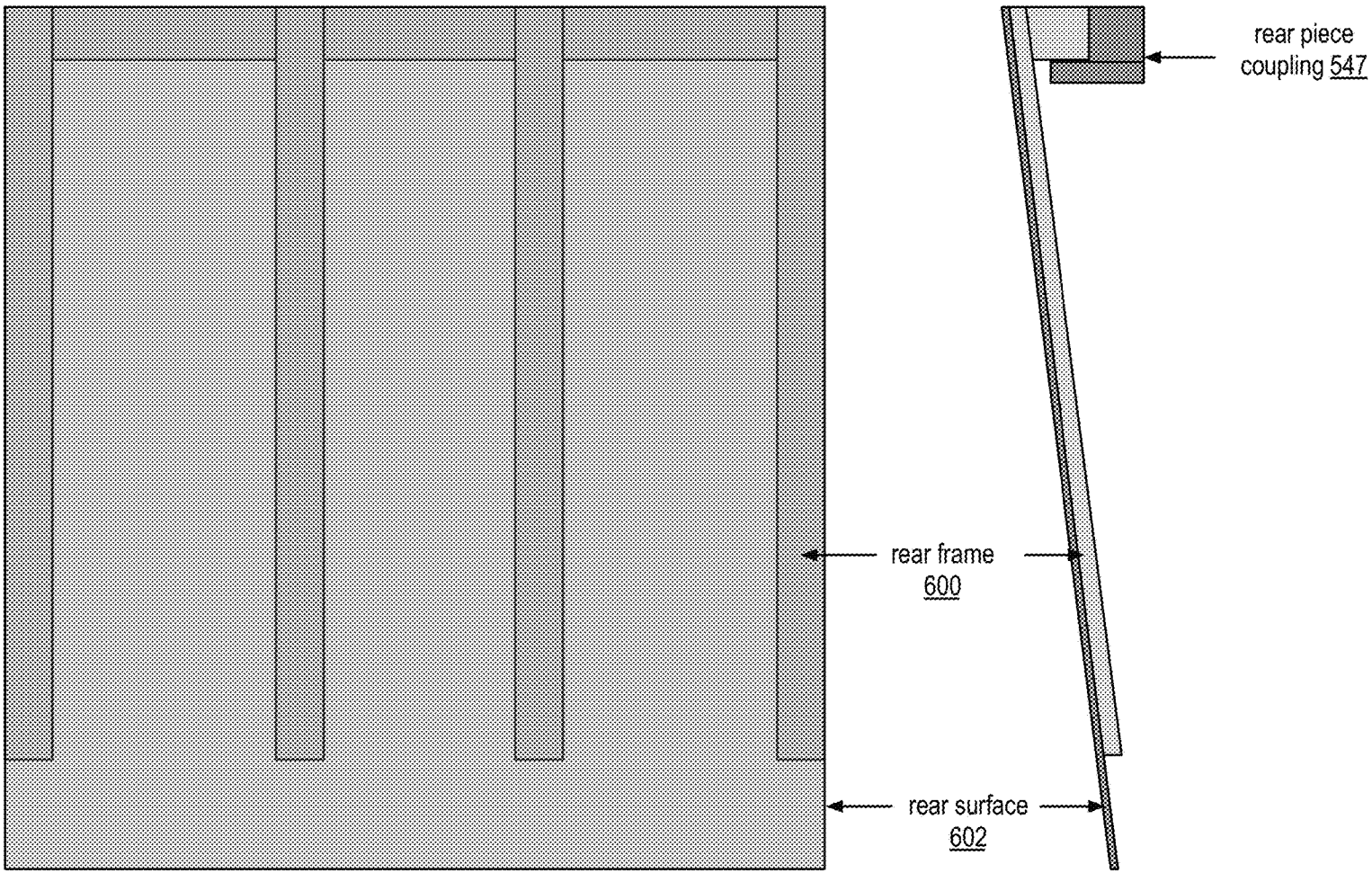
FIG. 6A top view
FIG. 6B side view left rear frame 611
rear support frame 600-1
securing bracket 600-2
right rear frame 601
rear view compressible material 600-3
rear frame 600
rear support frame 600-1
bottom view side view rear piece 502

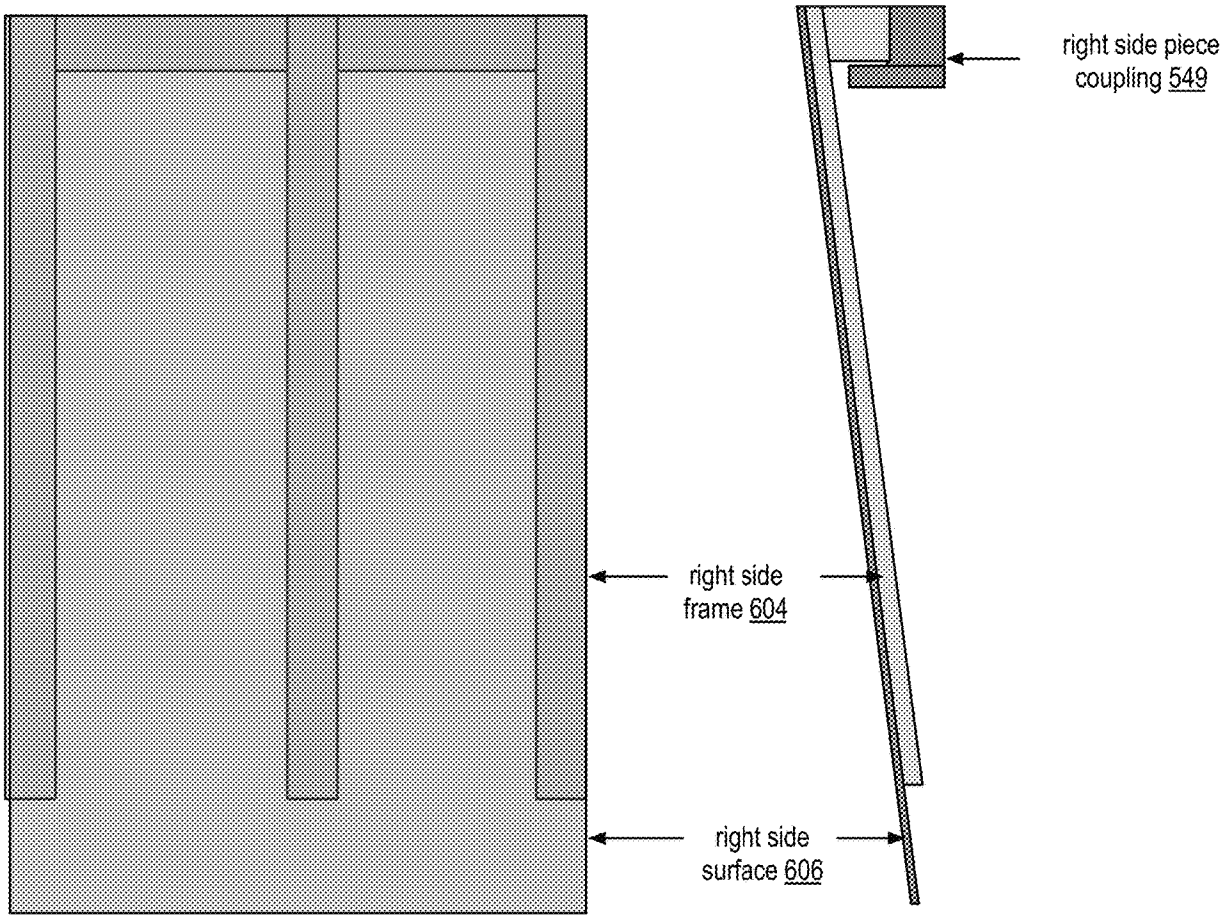
side view FIG. 7B
top view FIG. 7A right rear frame 601
right side support frame 604-1
right front frame 605
compressible material 604-3
securing bracket 604-2
rear view rear side frame 604
right side support frame 604-1
bottom view side view right side piece 512 right front
piece 516 top view left side piece 508 side view left front frame 615
left side support frame 608-1
securing bracket 604-2
rear view compressible material 604-3
left rear frame 611
left side support frame 608-1
bottom view left side frame 608
side view left side piece 508 left front
piece 514

MODULAR BULLPEN MOUND WITH REPLACEABLE TRAYS

CROSS REFERENCE TO RELATED PATENTS

The present U.S. Utility Patent Application claims priority pursuant to 35 U.S.C. § 120 as a continuation of U.S. Utility application Ser. No. 15/201,531, entitled "MODULAR PITCHING MOUND WITH REPLACEABLE TRAYS", filed Jul. 4, 2016, issuing as U.S. Pat. No. 10,173,123 on Jan. 8, 2019, which claims priority pursuant to 35 U.S.C. § 120 as a continuation-in-part of U.S. Utility Application Ser. No. 14/506,299, entitled "REPLACEABLE SECTIONS OF A PITCHING MOUND AND APPLICATIONS THEREOF," filed Oct. 3, 2014, issued as U.S. Pat. No. 9,381,419 on Jul. 5, 2016, which is a continuation of U.S. Utility application Ser. No. 13/593,360, entitled "REPLACEABLE SECTIONS OF A PITCHING MOUND AND APPLICATIONS THEREOF," filed Aug. 23, 2012, issued as U.S. Pat. No. 8,882,615 on Nov. 11, 2014, all of which are hereby incorporated herein by reference in their entirety and made part of the present U.S. Utility Patent Application for all purposes.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

Technical Field of the Invention

This invention relates generally to sporting equipment and more particularly to baseball equipment.

Description of Related Art

From Little League to the major leagues, baseball prescribes rules regarding the physical requirements of pitching mounds. For example, a major-league pitching mound is 18 feet in diameter with a maximum height of 10 inches. In addition, major league rules prescribed that the mound has a level area and a sloped area. While the rules prescribed the physical dimensions of a pitching mound, from field to field, and from bullpen to field, the implementation of a pitching mound varies. For instance, the height of the mound will vary, the prescribed slope will vary, etc.

In addition to varying implementations of a mound, during a game, the mound experiences degradation. For instance, the area immediately adjacent to the pitching rubber (where the pitcher drives) wears down creating holes. In addition, where the pitcher lands on the slope area creates holes. The holes in the drive area and/or in the sloped area caused the pitcher to make adjustments throughout a game. Further, if the mound is not properly maintained, the holes expand in size and depth over a series of multiple games. As the holes expand, the pitcher has to continually adjust his pitching mechanics. Continual adjustment of pitching mechanics increases the pitcher's risk of injury and degrades the pitcher's ability to be consistent.

In multiple use stadiums (e.g., for baseball, softball, and/or soccer), the pitching mound is portable so that it can be placed on the field for baseball games, but removed when the field is needed for another sport. Such portable pitching mounds are made of one or more pieces that are covered with artificial turf. The size, the shape, and cost of portable mounds vary greatly. Some portable mounds are not of the proper dimensions for the level section and/or the sloped section of the mounds, others are not rigid structures such that they "give" when the pitcher is pitching; and almost all have a lip on the front edge.

As such, from field to field, the size, shape, and rigidity of portable pitching mounds vary, causing the pitcher to adjust his pitching mechanics to conform to the mound. In addition, because the mounds are covered with artificial turf, pitchers cannot wear cleats (metal or plastic), thus they wear tennis shoes or similar types of shoes. Further, if a pitching change is made mid-inning and the new pitcher was playing a position, the game is paused while the new pitcher changes out of his cleats and into tennis shoes.

Still further, portable pitching mounds use differing types of turf with differing lengths and textures. As such, the friction coefficient of the portable pitching mounds varies from mound to mound depending on the type of turf. Since pitching starts from the ground up with how the pitcher's feet engage the ground throughout the pitching motion, varying friction coefficients of the mounds changes the pitching motion (i.e., the pitching mechanics). Again, a pitcher is adjusting his mechanics to the varying conditions of the pitching mound. Note that the friction coefficient of a turf mound varies greatly as moisture collects on its surface.

The lip on the front edge of the portable pitching mounds comes into play regularly during games. For example, a batted ball hits the lip it may reflect into foul territory. Thus, instead of a base hit up the middle, it is a foul ball. As another example, a batted ball may hit the lip and reflect up towards the pitcher's head.

BRIEF DESCRIPTION OF THE SEVERAL VIEWS OF THE DRAWING(S)

FIG. 1-1 is a schematic diagram of another embodiment of a modular game pitching mound in accordance with an invention of the parent patent;

FIGS. 2A-2C are a schematic diagram of an embodiment of a lower base outer frame in accordance with the present invention;

FIGS. 2I-2J are a schematic diagram of an embodiment of an assembled base frame in accordance with the present invention;

FIGS. 3N-3R are a schematic diagram of an embodiment of a nose piece cap in accordance with the present invention;

FIGS. 4A-4C are a schematic diagram of an embodiment of a drive tray in accordance with the present invention;

FIGS. 6A-6B are a schematic diagram of an embodiment of a rear piece in accordance with the present invention;

FIGS. 7A-7B are a schematic diagram of an embodiment of a right side piece in accordance with the present invention;

DETAILED DESCRIPTION OF THE INVENTION

Figure 1:
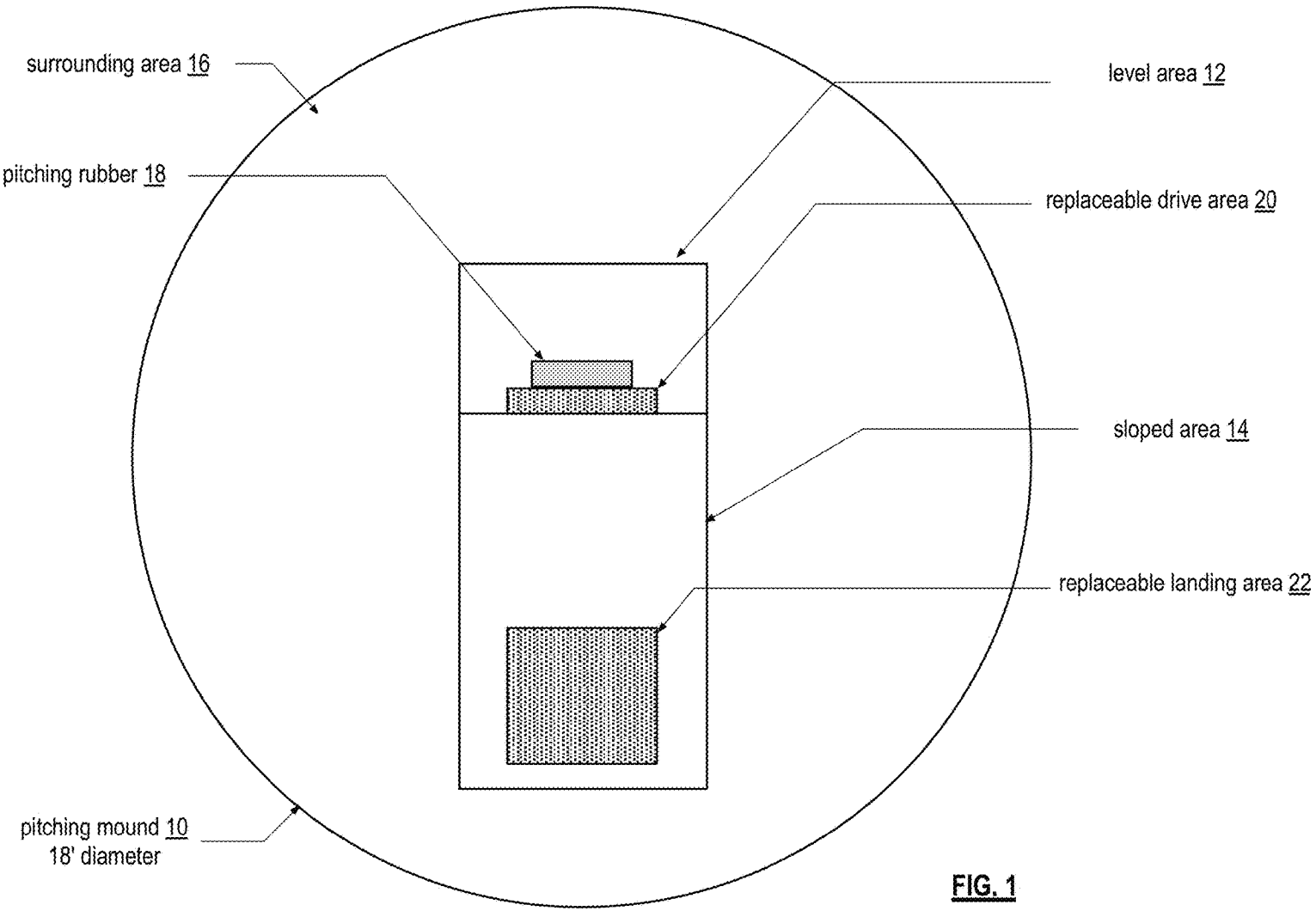
FIG. 1 is a schematic diagram of an embodiment of a modular game pitching mound in accordance with an invention of the parent patent.
Figure 1:
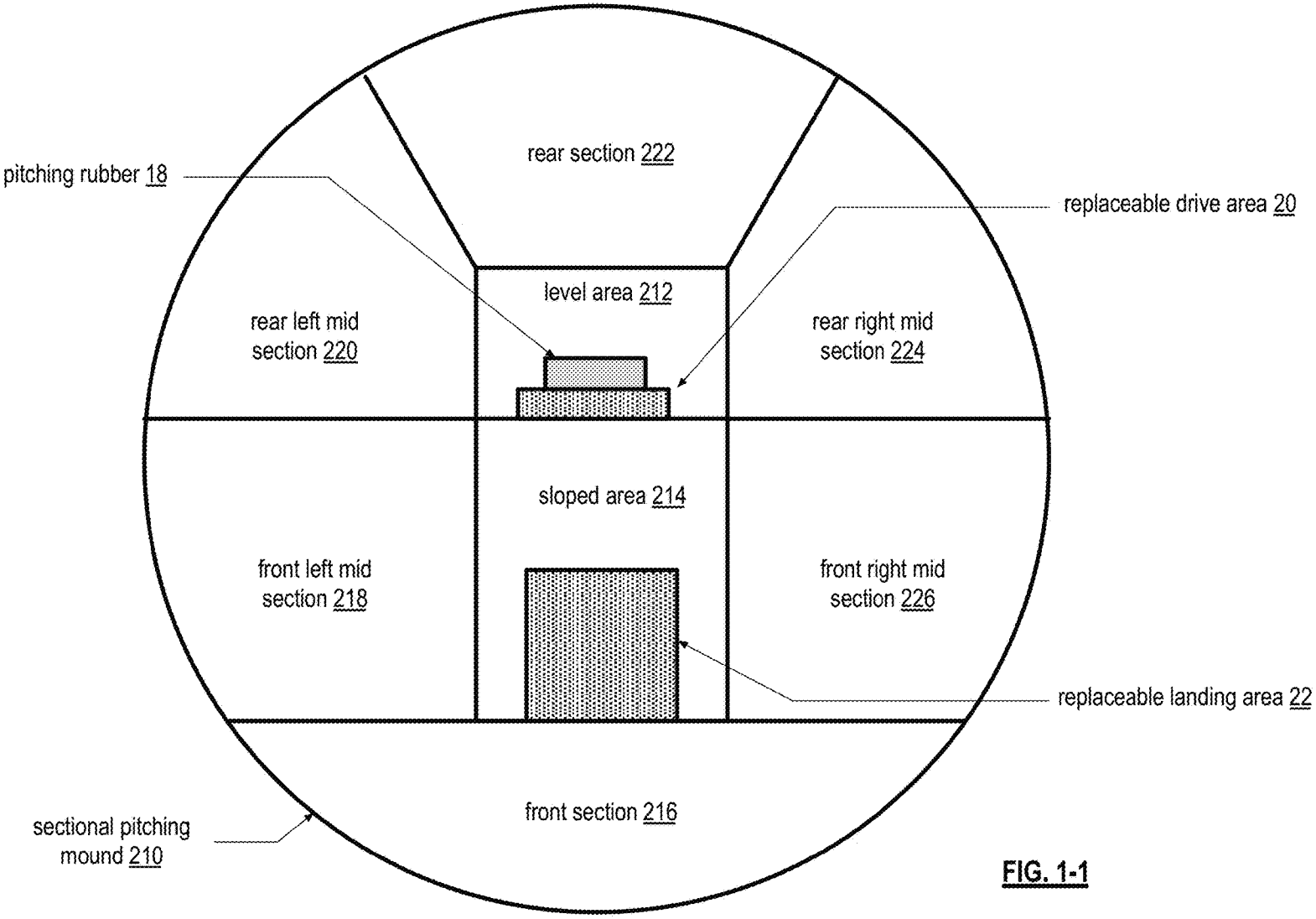

FIG. 1 is a top view diagram of an embodiment of a pitching mound 10 that includes a level area 12, a sloped area 14, a surrounding area 16, a pitching rubber 18, a replaceable drive area 20, and a replaceable landing area 22. The pitching mound 10 is positioned on a baseball field and has dimensions per baseball rules. For example, the major league baseball (MLB) rules provide that the pitching mound has a diameter of 18 feet. In addition, the rules prescribe that the mound 10 has a level area 12 (e.g., 34 inches in length by 60 inches in width) and a sloped area 14 (e.g., 6 feet long, 60 inches wide, and a slope of 1 inch per 1 foot). The surrounding areas have no specific rules as to their slope.

The level area 12 includes a pitching rubber 18 and a replaceable drive area 20. The replaceable drive area 20 may reside in front of the pitching rubber 18 or it may include the pitching rubber 18. In general, the replaceable drive area 20 includes a replaceable drive tray and a drive area receptacle. The drive area receptacle is embedded or fixed within the level area 12 of the pitching mound and is of a size to securely receive the replaceable drive tray. In this manner, the replaceable drive tray can be readily replaced during a game as needed. Note that the replaceable drive area 20 maybe 6 to 12 inches long by 24 to 34 inches wide.

The sloped area 14 includes a replaceable landing area 22. The replaceable landing area 22 is positioned within the sloped area 14 to accommodate the landing foot of most pitchers. In general, the replaceable landing area 22 includes a replaceable tray and a landing area receptacle. The landing area receptacle is embedded or fixed within the sloped area 14 of the pitching mound and is of a size to securely receive the replaceable landing tray. In this manner, the replaceable landing tray can be readily replaced during a game as needed. Note that the replaceable landing area 20 maybe 24 to 36 inches long by 24 to 34 inches wide.

The surrounding area 16 may be fabricated using one or more pieces. For example, the surrounding area 16 may include one piece that encircles the level area 12 and the sloped area 14. In another example, the surrounding area 16 includes a plurality of sections that collectively encircle the level area 12 and the sloped area 14.

FIG. 1-1 is a top view diagram of an embodiment of a sectional pitching mound 210 that includes a level area 212, a sloped area 214, and one or more surrounding areas 216-226. The level area 212 includes the pitching rubber 18 or 102 and the replaceable drive area 20; and the sloped area 214 includes the replaceable landing area 22 and may further includes the access box 100.

In the present figure, the surrounding areas includes a front section 216, a front left mid-section 218, a rear left mid-section 220, a rear section 222, a right rear mid-section 224, and a right front mid-section 226. The front left and right mid sections 218 and 226 have a side that aligns with the sloped area 214. The rear left and right mid sections 220 and 224 have a side that aligns with the level area 212.

Each of the surrounding areas 216-226 slopes from the level area 212 or from the sloped area 214 to ground level and may include a base and one or more trays to hold mound fill material. The surrounding areas 216-226, the level area 212, and the sloped area 214 connect to each other to form a unified mound that conforms to baseball rules (e.g., a diameter of 18 feet, a height of 10 inches, the level area is 34×60 inches, and the sloped area is 60×72 inches with a slope of 1 inch per foot). The connecting of the areas may be done by abutment, by track mechanisms, by hardware, etc. Note that there may be more or less surrounding areas based on ease of movement, ease of assembly, etc. Further note that once the mound 210 is assembled, it may be desirable to add and tamp mound fill material along the edges of the sections to better blend the sections together. With such a sectional mound 210, a mound that conforms to the baseball rules can be repeatedly created and recreated from baseball field to baseball field.

Figure 1A:
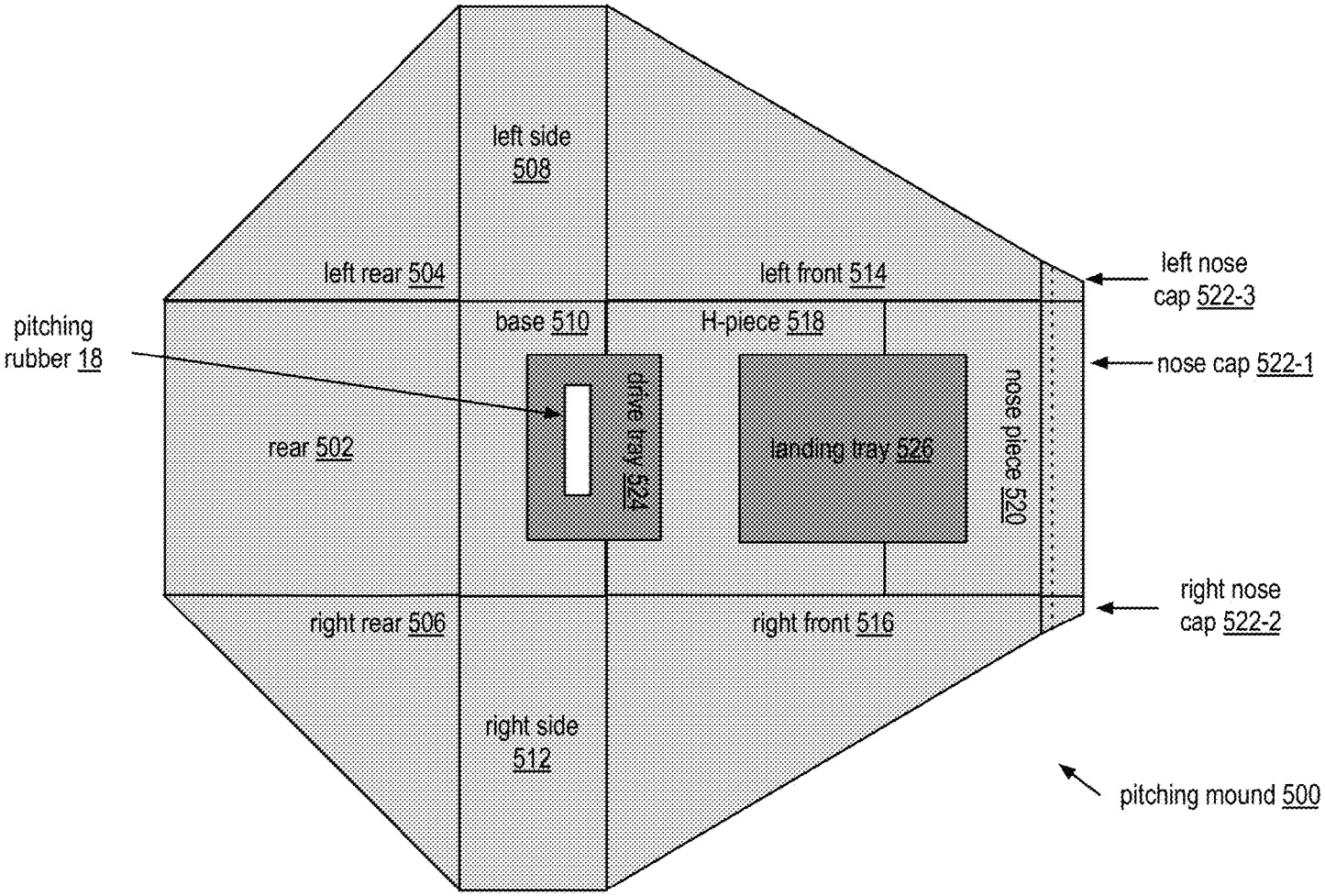
FIG. 1A is a schematic diagram of another embodiment of a modular game pitching mound in accordance with the present invention.

FIG. 1A is a schematic diagram of an embodiment of a modular game pitching mound 500 that includes a rear piece 502, a left rear piece 504, a right rear piece 506, a left slide piece 508, a base piece 510, a right side piece 512, a left front piece 514, a right front piece 516, an H-piece 518, a nose piece 520, a center nose cap 522-1, a right nose cap 522-2, a left nose cap 522-3, a drive tray 524, and a landing tray 528. Each of the pieces 502-526 may be constructed of wood, plastic, steel, fiberglass, rubber, carbon fiber, aluminum, and/or other material that may be shaped into the form of the respective piece.

Each of the pieces 502-520 interlock with each other to form the mound 500. In one embodiment, the pieces 502-520 interlock together without hardware, which allows for ease of set up and tear down. When assembled, the pieces 502-520 provide a support and/or containment structure for the drive tray 524 and the landing tray 526. Each of the pieces 502-520 is constructed to have a surface type. For example, each of the pieces 502-520 have a plywood surface substantially covered with artificial turf. As a specific example, the turf is wrapped around the edges of at least some of the pieces 502-520 to provide a coupling friction.

As another example, each of the pieces 502-520 have a rubber surface, which may or may not be covered with artificial turf. For instance, if the rubber surface is relatively soft and resilient, it will not be covered in turf to allow the pitcher's cleats to grip the surface. If, however, the rubber is relatively hard and/or not resilient, the surface is covered with turf. Note that one or more forms of adhering the artificial turf to the surface of each piece may be used, such as gluing, stapling, nailing, etc.

In yet another example, at least some of the surfaces of the pieces 502-520 include trays for holding pitching mound clay. As a specific example, the base 510, the H-piece 518, and the nose piece 520 have surface trays for holding pitching mound clay which the remaining pieces have a surface covered with turf.

The drive tray 524 is constructed to hold pitching mound clay, which at least partially encircles a pitching rubber 18. The drive tray 524 is primarily supported by the base piece 510 and is partially contained by the H-piece 516. The base piece 510 and/or the drive tray 524 include a mechanism for removal of the drive tray 524. For example, one or more of the drive tray 524 and the base piece 510 include handles and/or slots to assist in the removal and installation of the drive tray 524. In a particular, embodiment, when the H-piece is removed, one or more handles and/or handholds of the drive tray are accessible to remove it from the base piece 510. One or more embodiments of the drive tray 524 will be discussed in one or more remaining figures.

The landing tray 526 is constructed to hold pitching mound clay. The landing tray 526 includes its own supporting structure and is contained by the base piece 510 and the H-piece 516. In addition, the landing tray 526 includes a mechanism for removal from the mound 500. For example, the landing tray 526 includes wheels, handles and/or handholds to assist in its removal. In a particular, embodiment, when the nose piece 520 is removed, one or more handles and/or handholds of the landing tray are accessible to remove it from the mound. One or more embodiments of the landing tray 564 will be discussed in one or more remaining figures.

Note that pitching mound clay weights about one-hundred pounds per cubic foot. If an equivalent mound of mound 500 were made of clay and is in accordance with professional baseball specifications, it would require approximately 86 cubic feet of clay, which weighs approximately 8,600 pounds. For the modular mound 500 to be transportable by two people without the use of powered equipment, each individual piece 502-526 weighs less than 300 pounds, including the clay. As such, the height, width, and depth of the drive tray 524 and of the landing tray 526 are selected to meet the desired per piece maximum weight.

In an embodiment of the modular pitching mound 500, it includes a removable drive area that includes an area for a pitching rubber (e.g., drive tray 524), a removable landing area (e.g., landing tray 526), a modular level and sloped section (e.g., one or more of base piece 510, H-piece 518, nose piece 520, and nose caps 522-1 through 522-3), and a modular mound skirt section (e.g., one or more of pieces 502, 504, 506, 508, 512, 514, and 516). The modular level and sloped section, when assembled, supports the removable drive area in a first position and at least encircles the removable landing area. The modular mound skirt section couples to and encircles the modular level and sloped section. Note that, at least one of the removable drive area and the modular level and sloped section include a removable mechanism for assisting with removal of the removable drive area from the modular level and sloped section.

Figure 1B:
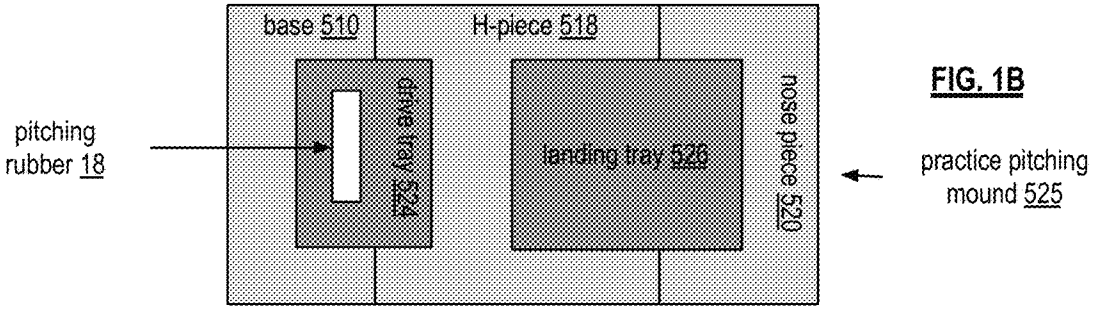
FIG. 1B is a schematic diagram of an embodiment of a modular practice pitching mound in accordance with the present invention.

FIG. 1B is a schematic diagram of an embodiment of a modular practice pitching mound 525 that includes the base 510, the H-piece 518, the nose piece 520, the drive tray 524 and the landing tray 526. The modular practice pitching module 525 is usable indoors or out. For indoor use, the modular practice mound 525 may further include a spill-over tray or tarp (not shown). For instance, a small amount of clay may be expelled from the drive tray and/or the landing tray. In this instance, the spill-over tray or tarp catches the expelled clay and prevents it from reaching the floor.

Figure 1C:
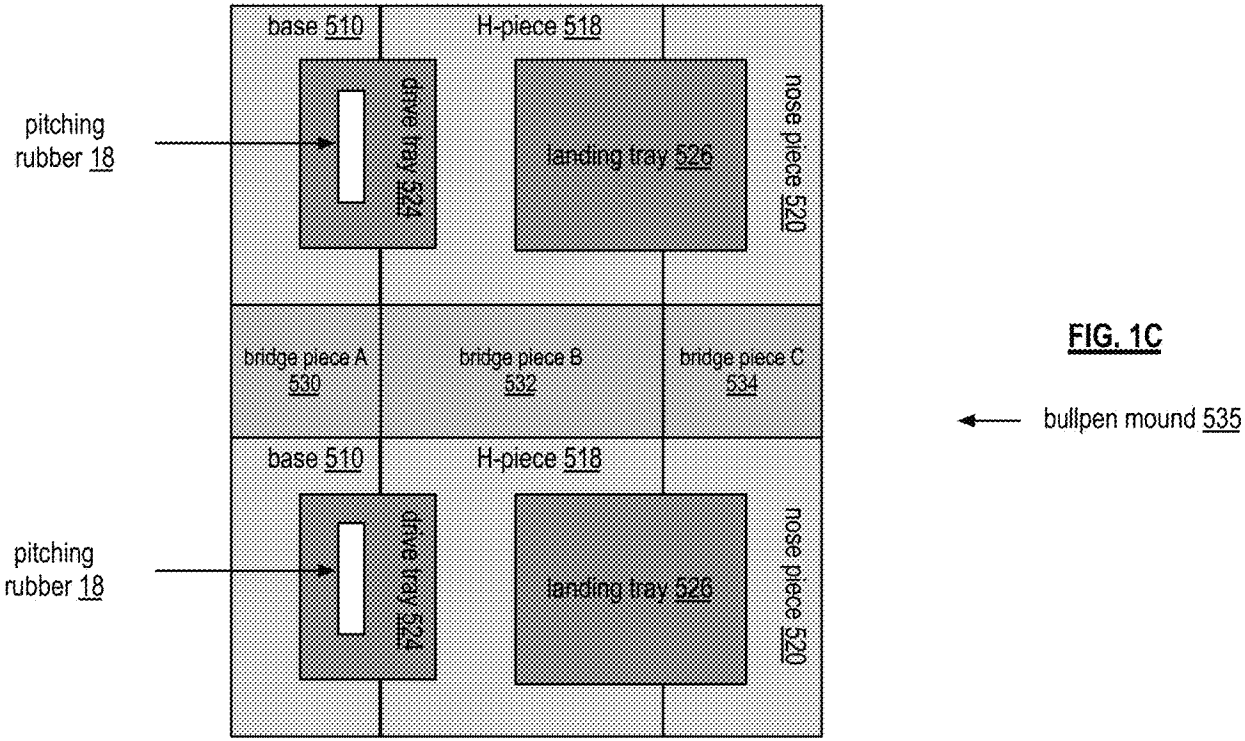
FIG. 1C is a schematic diagram of an embodiment of a modular bullpen pitching mound in accordance with the present invention.

FIG. 1C is a schematic diagram of an embodiment of a modular bullpen pitching mound 535 that includes two practice mounds 525 and an interconnecting bridge. In an embodiment, the interconnecting bridge includes bridge pieces A, B, and C 530, 532, and 534. Bridge piece A 530 has a height and length corresponding to the height and length of the base piece 510; its width is approximately ½ to one times the width of the base piece 510. Bridge piece B 532 has a height, length, and slope corresponding to the H-piece 518; its width is approximately ½ to one times the width of the H-piece 518. Bridge piece C 534 has a height, length, and slope corresponding to the nose piece 520; its width is approximately ½ to one times the width of the nose piece 520.

Each of the bridge pieces 530-532 may be constructed of wood, plastic, steel, fiberglass, rubber, carbon fiber, aluminum, and/or other material that may be shaped into the form of the respective piece. The surface of each of the bridge pieces is constructed to have a surface type. For example, each of the pieces have a plywood surface substantially covered with artificial turf. As another example, each of the pieces have a rubber surface, which may or may not be covered with artificial turf. In yet another example, at least some of the surfaces of the pieces include trays for holding pitching mound clay.

Figure 1D:
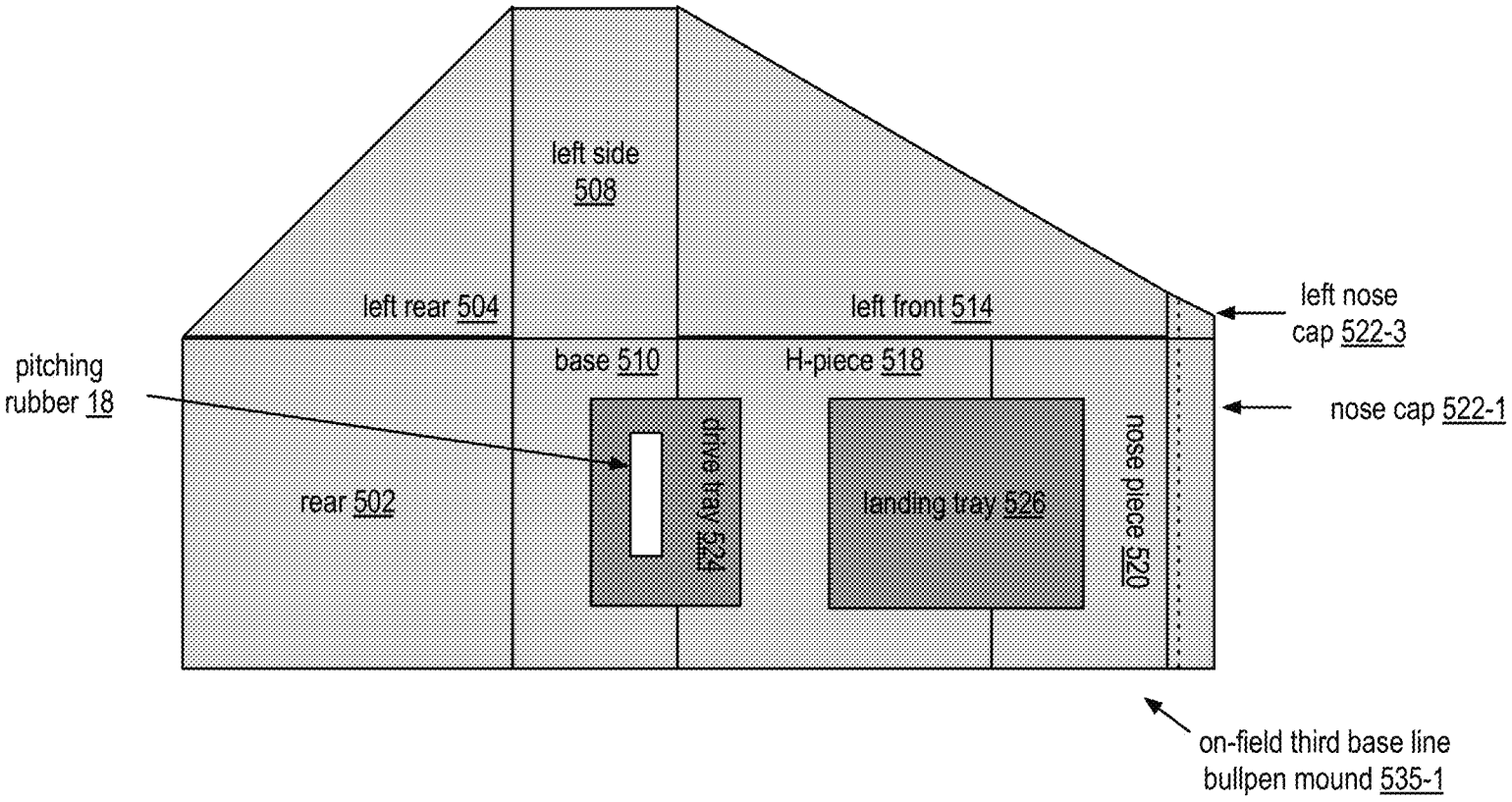
FIG. 1D is a schematic diagram of another embodiment of a modular bullpen pitching mound in accordance with the present invention; pitching mound in accordance with the present invention.

FIG. 1D is a schematic diagram of another embodiment of a modular bullpen pitching mound 535-1 for use on-field down the third base line. The bullpen mound 535-1 includes the rear piece 502, the left rear piece 504, the left side piece 508, the base piece 510, the left front piece 514, the H-piece 518, the nose piece 520, nose caps 522-1 and 522-3, the drive tray 524, and the landing tray 526.

Figure 1E:
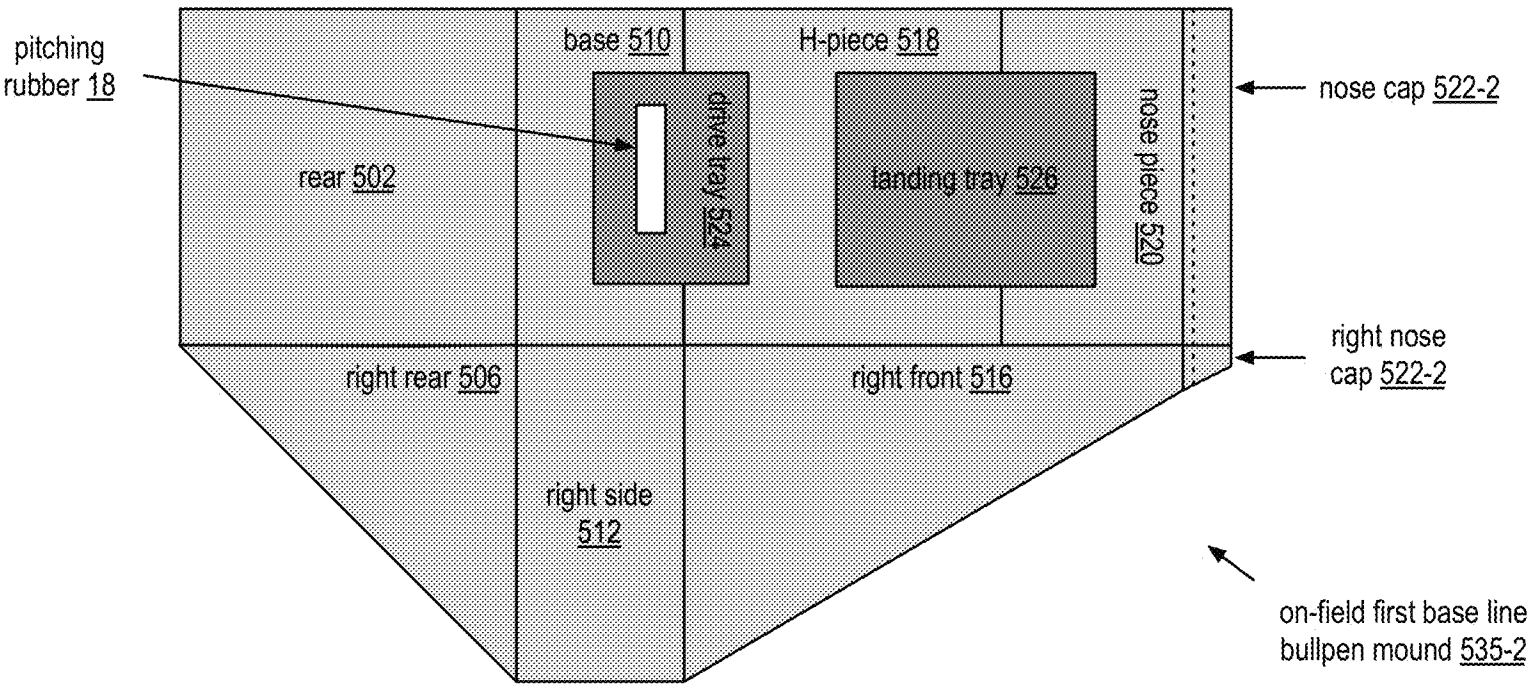
FIG. 1E is a schematic diagram of another embodiment of a modular bullpen pitching mound in accordance with the present invention.

FIG. 1E is a schematic diagram of another embodiment of a modular bullpen pitching mound 535-2 for use on-field down the first base line. The bullpen mound 535-1 includes the rear piece 502, the right rear piece 506, the right side piece 512, the base piece 510, the right front piece 516, the H-piece 518, the nose piece 520, nose caps 522-1 and 522-2, the drive tray 524, and the landing tray 526.

Figure 1F:
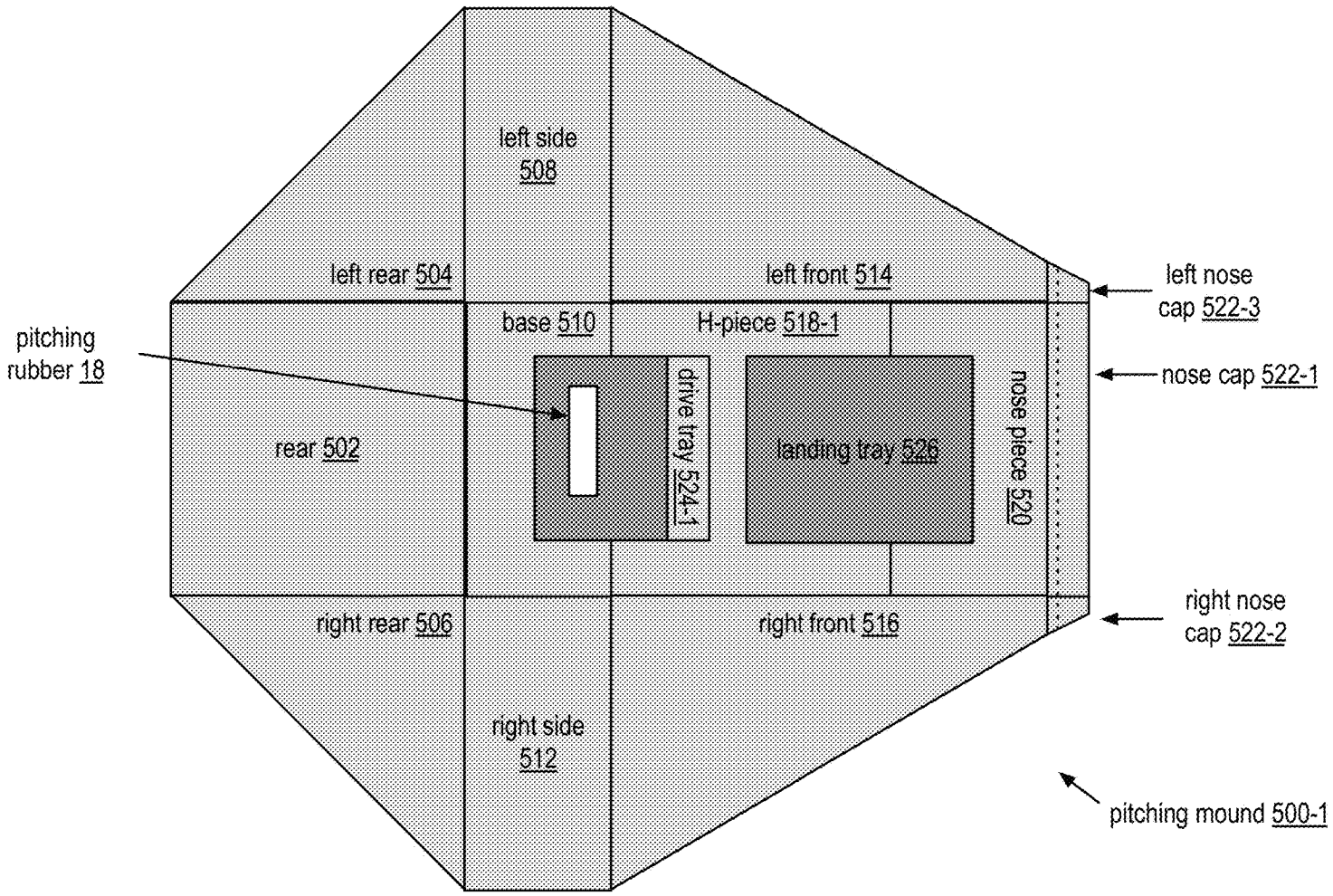
FIG. 1F is a schematic diagram of another embodiment of a modular game pitching mound in accordance with the present invention.

FIG. 1F is a schematic diagram of another embodiment of a modular game pitching mound 500-1 that includes the rear piece 502, the left rear piece 504, the right rear piece 506, the left slide piece 508, the base piece 510, the right side piece 512, the left front piece 514, the right front piece 516, the modified H-piece 518-1, the nose piece 520, the center nose cap 522-1, the right nose cap 522-2, the left nose cap 522-3, a modified drive tray 524-1, and the landing tray 528. The modified drive tray 524-1 and the modified H-piece 518-1 may each be constructed of wood, plastic, steel, fiberglass, rubber, carbon fiber, aluminum, and/or other material that may be shaped into the form of the respective piece.

The modified drive tray 524-1 include a clay fill area and a solid fill area. The solid fill area includes a surface that corresponds to the surface of the base piece 510. The modified drive tray 524-1 is longer than the drive tray 524. Accordingly, the modified H-piece 518-1 has a narrower cross area than H-piece 518. The modified drive tray and the modified H-piece mate with, are supported by, and/or are contained by the other pieces of the mound in a similar manner as their non-modified counterparts.

Figure 1G:
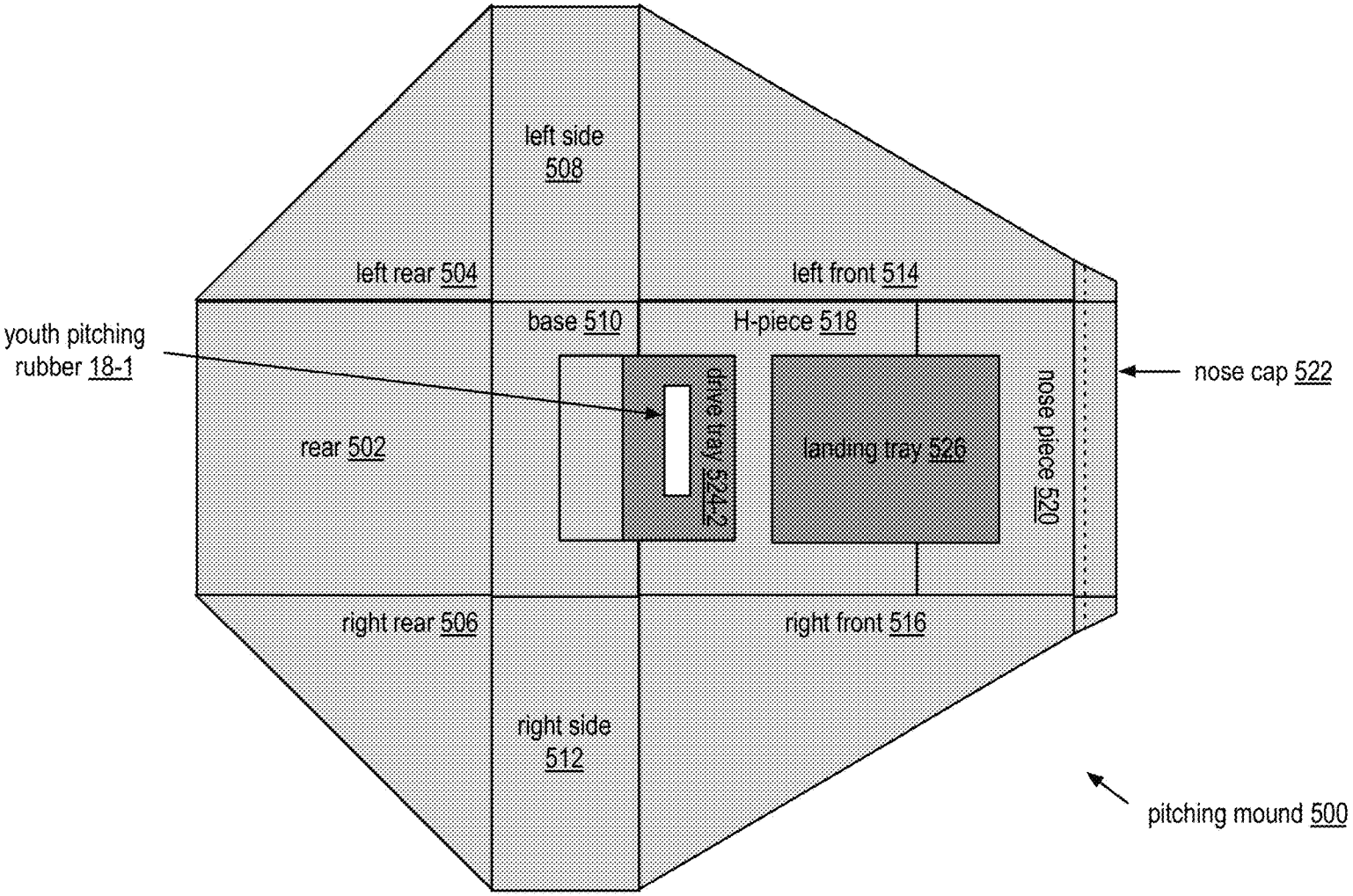
FIG. 1G is a schematic diagram of another embodiment of a modular game pitching mound in accordance with the present invention.

FIG. 1G is a schematic diagram of another embodiment of a modular game pitching mound 500-1 that includes the rear piece 502, the left rear piece 504, the right rear piece 506, the left slide piece 508, the base piece 510, the right side piece 512, the left front piece 514, the right front piece 516, the modified H-piece 518-1, the nose piece 520, the center nose cap 522-1, the right nose cap 522-2, the left nose cap 522-3, a second modified drive tray 524-2, and the landing tray 528. The second modified drive tray 524-2 may be constructed of wood, plastic, steel, fiberglass, rubber, carbon fiber, aluminum, and/or other material that may be shaped into the form of the respective piece.

The second modified drive tray 524-2 include a clay fill area and a solid fill area, which includes a surface that corresponds to the surface of the base piece 510. The modified drive tray 524-1 is longer than the drive tray 524 and has the clay fill area towards the modified H-piece 518-1. This configuration supports pitchers that have a short stride.

FIGS. 2A-2C are a schematic diagram of an embodiment of a lower base outer frame 510-1 of the base piece 510. The lower base outer frame 510-1 includes H-piece alignment sections 542, alignment posts 540, a drive tray support area 544, and handles 546. The dimensions of the lower base outer frame are in accordance with the desired functionality of the mound in which it is included (e.g., an adult mound, a youth mound, or a combination thereof).

The handles 546 may be slots as shown or may be mechanical device (e.g., a handle, a hook, a strap, etc.) attached to the outer frame 510-1. Note that each side may include one or more handles 546. Further the rear and/or the front of the lower base outer frame 510-1 may include one or more handles. The handles may be of different types. For example, one handle may be slot and another handle may be a strap.

Figure 2F:
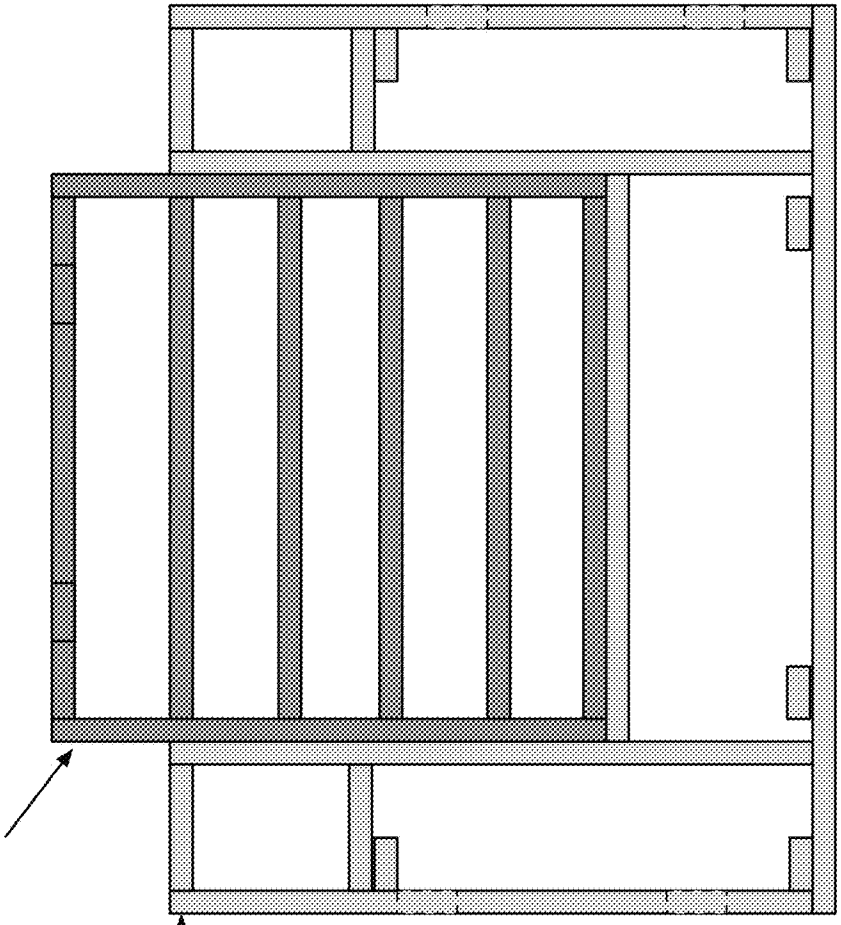
FIG. 2F are a schematic diagram of an embodiment of a completed lower base frame in accordance with the present invention.
Figure 2D:
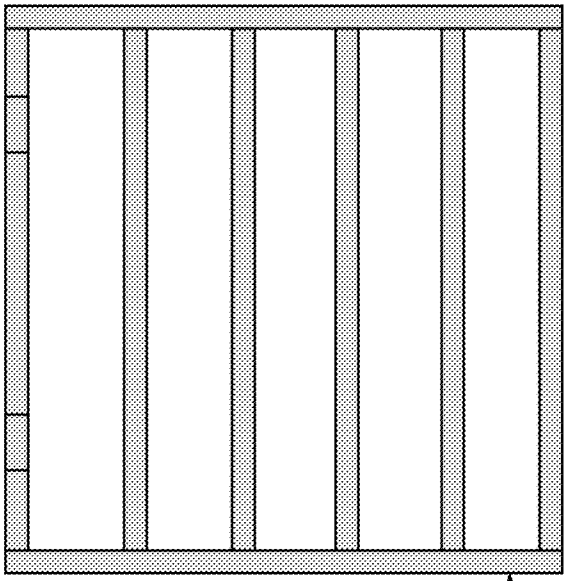
FIGS. 2D-2E are a schematic diagram of an embodiment of a lower base tray support frame in accordance with the present invention.
Figure 2E:
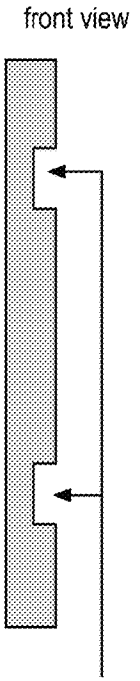
Figure 2H:
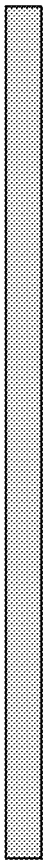
FIGS. 2G-2H are a schematic diagram of an embodiment of an upper base frame in accordance with the present invention.
Figure 2G:
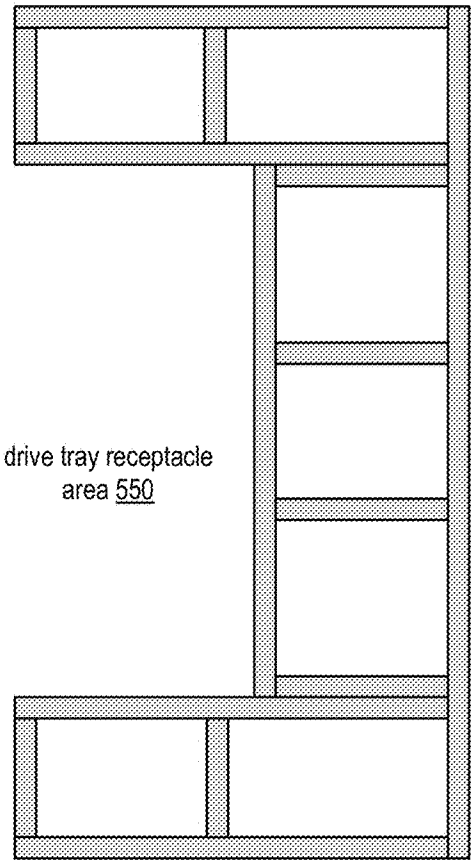

The alignment posts 460 are positioned and of a height to align the upper base frame 513 of FIGS. 2G-2H. Note that there may be more or less alignment posts 460 than shown in the present example.

The H-piece alignment sections 542 each includes a corresponding mechanism to the alignment mechanism of the H-piece 518. For example, the H-piece 518, or 518-1 has alignment posts that slide along and are held in place by guide posts within the H-piece alignment sections 542. As another example, the H-piece includes a coupling structure that is complimentary to the H-piece alignment sections 542. As a specific example, the H-piece includes square pegs and the H-piece alignment sections include square holes.

FIGS. 2D-2E are a schematic diagram of an embodiment of a lower base tray support frame 510-2, which includes drive tray extraction handles 548. The lower base tray support frame 510-2 has a width and length corresponding to the width and length of the drive tray 524, 524-1, or 524-2. The height of the lower base tray support frame 510-2 corresponds to the difference between the height of the drive tray 524, 524-1, or 524-1 and the height of the mound (e.g., any one of the mounds of FIGS. 1A through 1G).

FIG. 2F is a schematic diagram of an embodiment of a completed lower base frame 511, which includes the lower base tray support frame 510-2 coupled to the lower base outer frame 510-1. Depending on the construction materials of the lower base tray support frame 510-2 and the lower base outer frame 510-1, they may be coupled together in a variety of ways. For example, they may be screwed, nailed, glued, welded, bolted, and/or press-fitted together.

FIGS. 2G-2H are a schematic diagram of an embodiment of an upper base frame 513 that includes a drive tray receptacle area 550. The upper base frame 513 has a width and length corresponding to the width and length of the base piece 510. The height of the upper base frame 513 corresponds to the different between the height of the lower base frame 511 and the height of the base piece 510. The dimensions of the drive tray receptacle area 550 correspond to the width and length of the drive tray 524, 524-1, or 524-2. Note that the drive tray receptacle area 550 provides partial containment for the drive tray; the remaining containment is provided by the H-piece. Further note that containment refers to substantially limited movement in the x-direction the y-direction of a x, y, z coordinate system, where the z axis is perpendicular to the ground.

FIGS. 2I-2J are a schematic diagram of an embodiment of an assembled base frame 510-2, which includes the drive tray support frame 545, the lower base frame 510-1, and the upper base frame 513. The upper base frame 513 is placed on the lower base frame 510-1 in align with the alignment posts. The weight of the upper base frame 513 is typically sufficient to hold it in place. In some situations, it may be desired to mechanically couple the upper base frame 513 to the lower base frame 510-1 (e.g., nail, screw, weld, bolt, glue, etc.).

The top portion of the upper base frame 513 supports the surface being placed thereon. For example, if the surface is plywood covered with artificial turf, the plywood is attached (e.g., screwed, nailed, glued, etc.) to the upper base frame 513. Once the plywood is attached, the turf is attached (e.g., glued, stapled, et.) to the plywood.

From the top view perspective, the drive tray 524, 524-1, or 524-2 is placed on the drive tray support frame 545 and the H-piece is coupled to the base piece 510 via the H-piece alignment sections 542. Accordingly, the drive tray is contained by the base piece and H-piece, which are coupled together without hardware. Note that this embodiment of the base frame 510-1 is applicable for use in the practice mound 510.

Figures 2K, 2L:
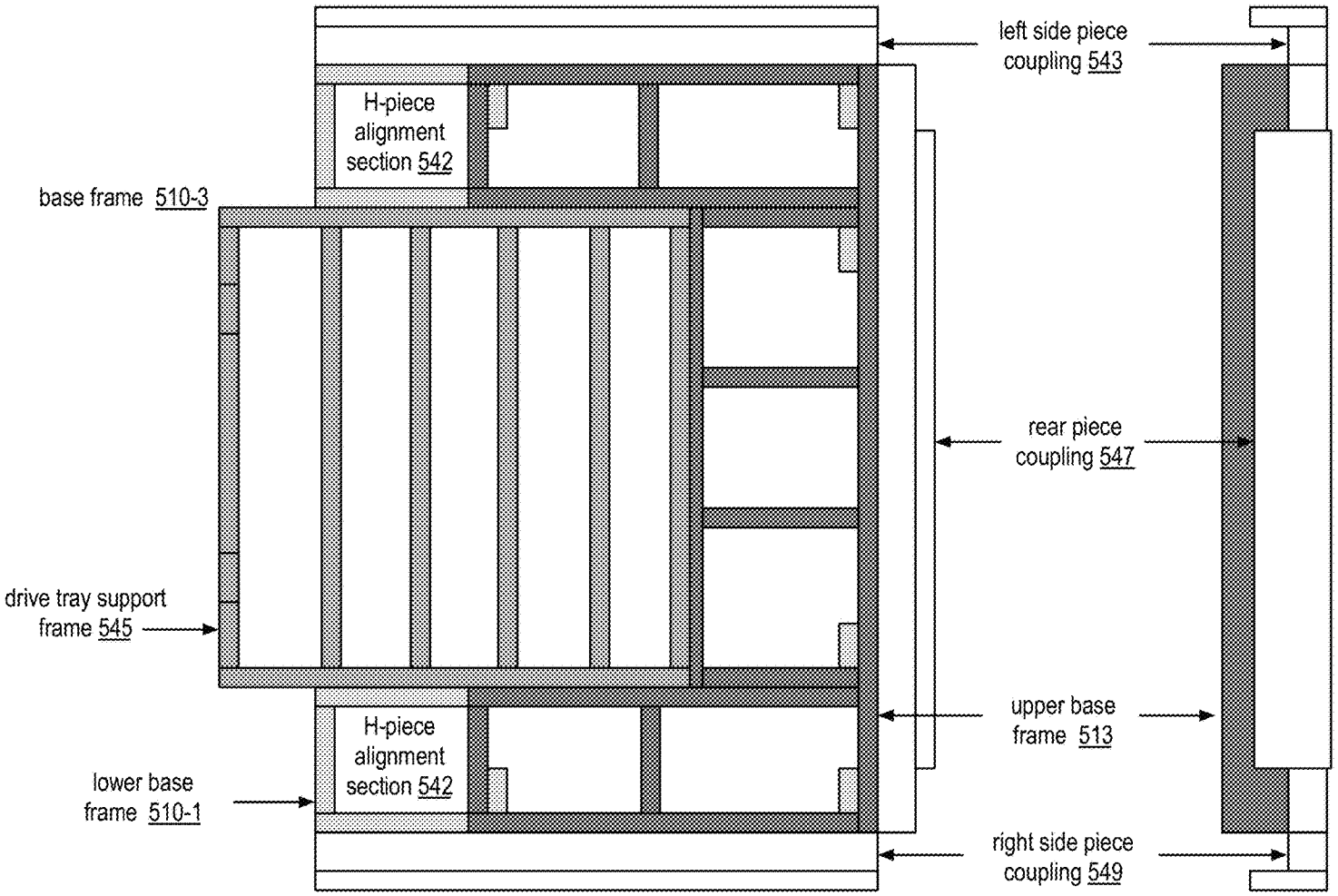
FIGS. 2K-2L are a schematic diagram of an embodiment of an assembled base frame in accordance with the present invention.

FIGS. 2K-2L are a schematic diagram of an embodiment of an assembled base frame 510-2, which is similar to the base frame 510-1 of FIGS. 2I-2J with the addition of a left side coupling mechanism 543, a rear coupling mechanism 547, and a right side coupling mechanism 549. The left side coupling mechanism 543 provides a coupling structure to support and connect with the left piece 508. For example, the left side coupling mechanism 543 includes a support beam coupled to the side of the base and a guide beam coupled to the support beam. The frame of the left side piece 508 is supported by the support beam and held to the base piece by the guide beam. The right side piece 512 is coupled to the base piece 512 in a similar manner via the right side piece coupling mechanism 549.

The rear piece coupling mechanism 547 also includes a support beam and a guide beam. The frame of the rear piece 502 is supported by the support beam of the rear piece coupling mechanism and held to the base piece 510 by the guide beam. The coupling mechanisms 543, 547, and 549 may be constructed of wood, plastic, steel, fiberglass, rubber, carbon fiber, aluminum, and/or other material that may be shaped into the form of the respective coupling mechanisms.

The base frame 510-3 is applicable for use with the mounds of FIGS. 1A, 1F, and 1G. For the on-field bullpen mound of FIG. 1D, the right side piece coupling mechanism 549 would be omitted. For the on-field bullpen mound of FIG. 1E, the left side piece coupling mechanism 543 would be omitted.

Figures 3A, 3B:
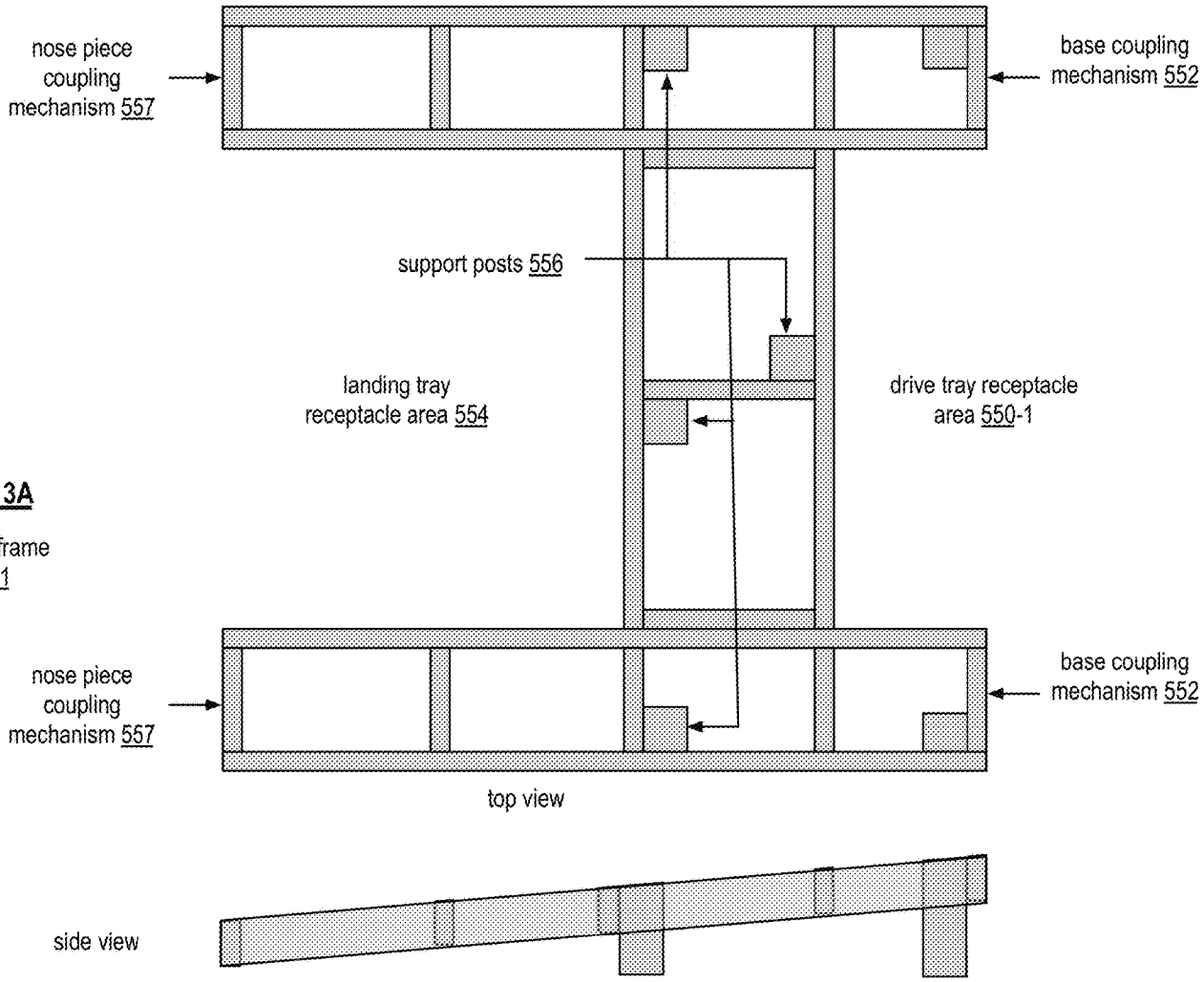
FIGS. 3A-3B are a schematic diagram of an embodiment of an H-Piece frame in accordance with the present invention.

FIGS. 3A-3B are a schematic diagram of an embodiment of an H-Piece frame 518-1 that includes base coupling mechanisms 522, a drive tray receptacle area 550-1, a landing tray receptacle area 554, a nose piece coupling mechanism 557, and support posts 556. The base coupling mechanism 522 includes a complimentary mechanism to the H-piece coupling mechanism of the base piece 510. Examples were discussed with reference to FIGS. 2A-2C as previously discussed.

As shown in the side view, the H-piece frame has a slope. The slope corresponds to the slope defined by baseball rules. For example, the slope for professional baseball is one inch per foot (4.76 degrees). Accordingly, the slope of the H-piece frame for an adult mound is one inch per foot or 4.76 degrees. As another example, the slope for a youth mound is five-eighths of an inch per foot (approximately 3 degrees). Accordingly, the slope of the H-piece frame for a youth mound is five-eighths of an inch per foot.

The width of the H-piece frame 518-1 corresponds to the width of the base piece 510 and the length of the H-piece frame is selected for convenience. For example, the length of the H-piece frame is sixty inches in an embodiment of an adult mound and forty-eight inches in a youth mound.

The dimensions of the drive tray receptacle area 550-1 are dependent on the size of the drive tray, the length of the H-piece, the length of the base piece 510, and desired tolerance to account for variances in the materials and wrapped turf edges. For example, if the drive tray is thirty-six inches wide, the width of the drive tray receptacle area 550-1 will be 36.25 inches to 37.5 inches depending on tolerances and wrapped turf edges. As another example, if the drive tray has a length of twenty-two inches and the length of the base piece drive tray opening is twelve includes, then the length of the drive tray receptacle area 550-1 is about ten to eleven inches depending on tolerances and wrapped turf edges.

The dimensions of the landing tray receptacle area 554 are dependent on the size of the landing tray, the length of the H-piece, the distance desired between the drive tray and the landing tray, and desired tolerance to account for variances in the materials and wrapped turf edges. For example, if the landing tray is thirty-six inches wide, the width of the landing tray receptacle area 554 will be 36.25 inches to 37.5 inches depending on tolerances and wrapped turf edges. As another example, if the landing tray has a length of forty-eight inches and the desired distance between the drive tray and the landing tray is eighteen inches (e.g., want the start of the landing tray to be thirty-six inches from the front edge of the pitching rubber), then the length of the landing tray receptacle area 554 is about thirty to thirty-one inches depending on tolerances and wrapped turf edges.

The support posts 556 are positioned to provide a stable structure when the H-piece is placed on a relatively flat service. The top portion of the H-piece frame 518-1 supports the surface being placed thereon. For example, if the surface is plywood covered with artificial turf, the plywood is attached (e.g., screwed, nailed, glued, etc.) to the H-piece frame 518-1. Once the plywood is attached, the turf is attached (e.g., glued, stapled, et.) to the plywood. The H-piece frame 518-1 is applicable for use with the practice mound of FIG. 1B.

The nose piece coupling mechanism 557 includes a complimentary coupling device to the H-piece coupling mechanism 559 of the nose piece 520. For example, the nose piece coupling mechanism includes an L-bracket that is attached to a top surface of the nose piece and couples to the front frame of the H-piece 518. In another example, the nose piece includes alignment posts that slide along and are held in place by guide posts within the coupling section 557 of the H-piece. As another example, the nose piece coupling mechanism includes a coupling structure that is complimentary to the H-piece coupling mechanism. As a specific example, the nose piece includes square pegs and the H-piece includes square holes.

Figures 3C, 3D:
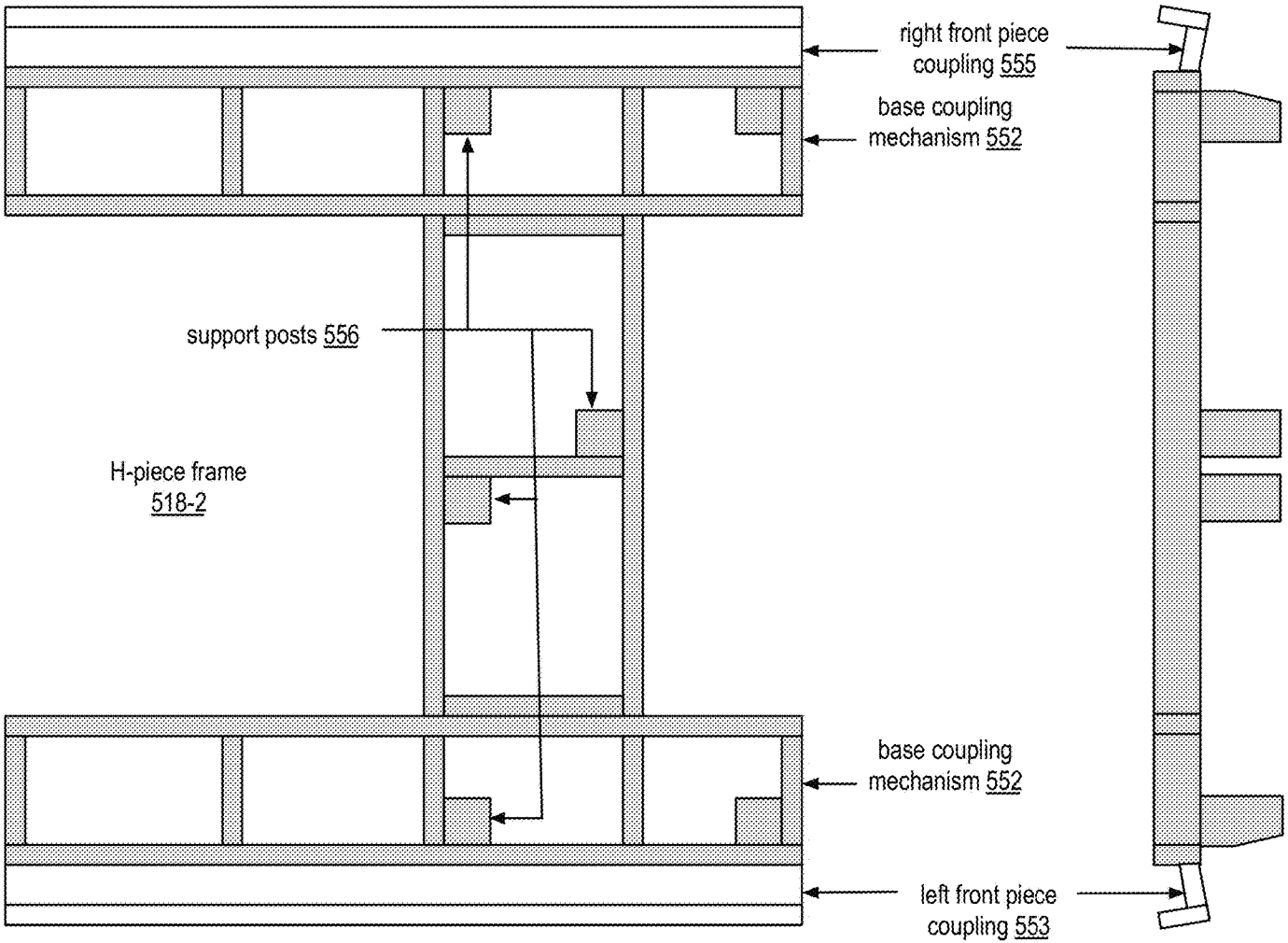
FIGS. 3C-3D are a schematic diagram of another embodiment of an H-Piece frame in accordance with the present invention.

FIGS. 3C-3D are a schematic diagram of another embodiment of an H-piece frame 518-2, which is similar to the H-piece frame 518-1 with the further inclusion of a right front coupling piece 555 and a left front coupling piece 553. The left front coupling mechanism 553 provides a coupling structure to support and connect with the left front piece 514. For example, the left front coupling mechanism 553 includes a support beam that is coupled to the side of the H-piece at an angle and a guide beam coupled to the support beam. The frame of the left front piece 514 is supported by the support beam and held to the H-piece piece by the guide beam. The right front piece 516 is coupled to the H-piece piece 518 in a similar manner via the right front coupling mechanism 555.

The H-piece frame 518-2 is applicable for use with the mounds of FIG. 1A. For the on-field bullpen mound of FIG. 1D, the right side piece coupling mechanism 555 would be omitted. For the on-field bullpen mound of FIG. 1E, the left side piece coupling mechanism 553 would be omitted.

Figures 3E, 3F:
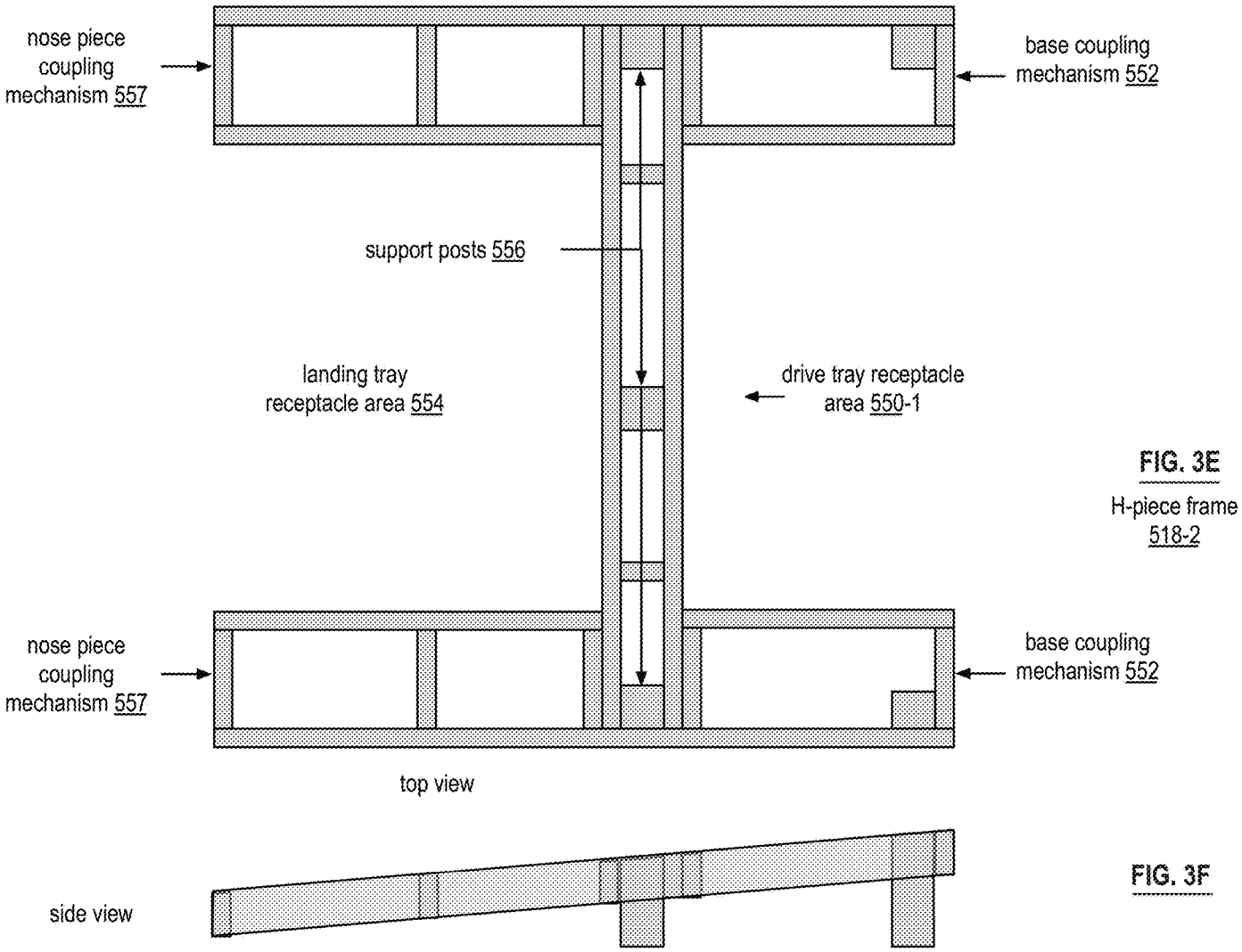
FIGS. 3E-3F are a schematic diagram of another embodiment of an H-Piece frame in accordance with the present invention.

FIGS. 3E-3F are a schematic diagram of another embodiment of an H-piece frame 518-3 that is similar to the H-piece frame 518-1 with the expectations that the length of the drive tray receptacle area 550-1 is longer and the distance between the drive tray receptacle area 550-1 and the landing tray receptacle area 554 is shorter. For example, if the drive tray length is thirty-six inches instead of twenty-two inches, then the length of the drive tray receptacle area 550-1 is fourteen inches longer than for the H-piece frame 518-1 or is about twenty-four to twenty-five inches depending on tolerances and wrapped turf edges. As a result of the longer drive tray, the distance between the drive tray receptacle area 550-1 and the landing tray receptacle area 554 is four inches (e.g., 18-14).

Figures 3G, 3H:
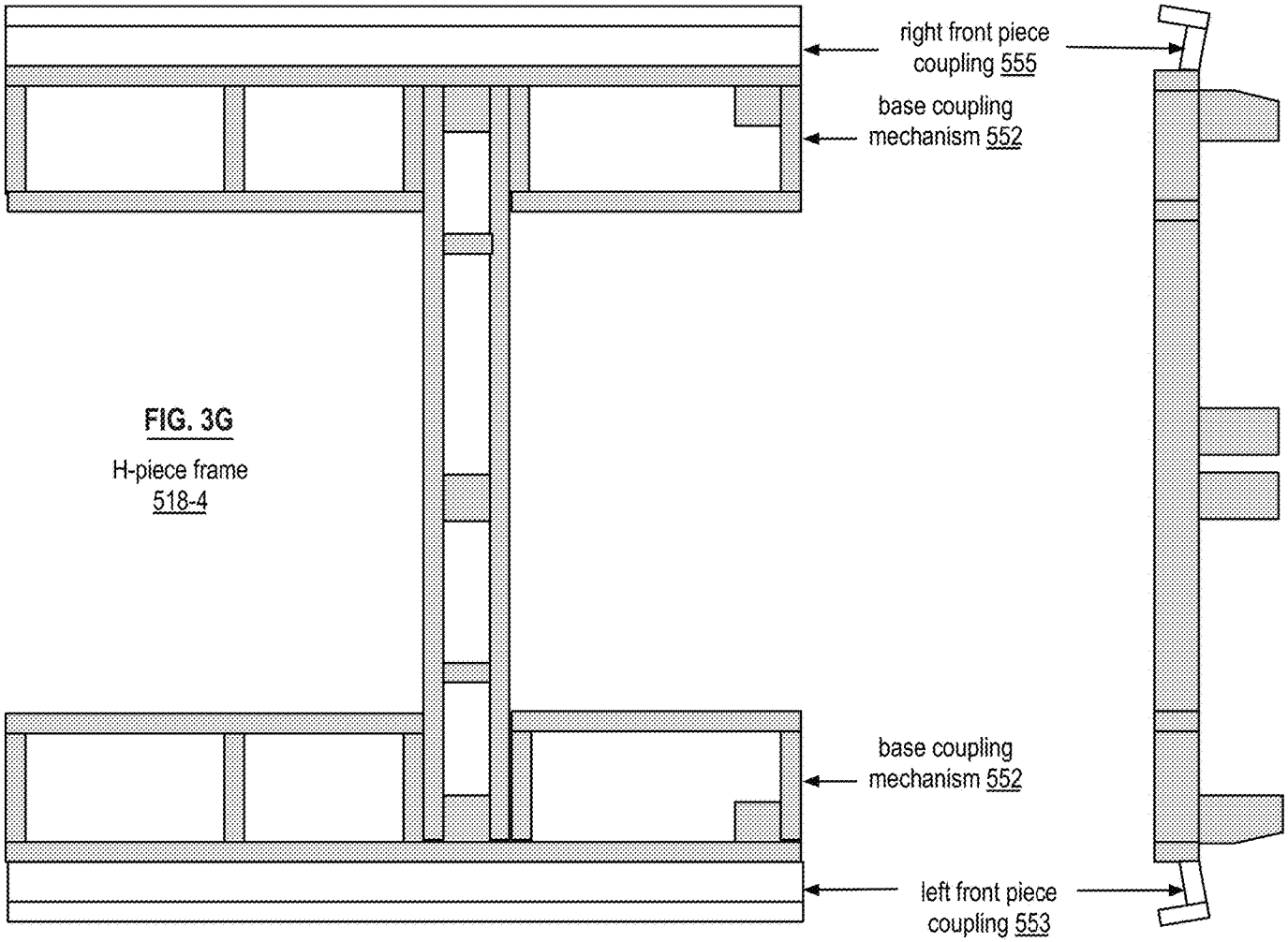
FIGS. 3G-3H are a schematic diagram of another embodiment of an H-Piece frame in accordance with the present invention.

FIGS. 3G-3H are a schematic diagram of another embodiment of an H-Piece frame 518-4, which is similar to the H-piece frame 518-3 with the further inclusion of a right front coupling piece 555 and a left front coupling piece 553. The left front coupling mechanism 553 provides a coupling structure to support and connect with the left front piece 514. For example, the left front coupling mechanism 553 includes a support beam that is coupled to the side of the H-piece at an angle and a guide beam coupled to the support beam. The frame of the left front piece 514 is supported by the support beam and held to the H-piece piece by the guide beam. The right front piece 516 is coupled to the H-piece piece 518 in a similar manner via the right front coupling mechanism 555.

The H-piece frame 518-4 is applicable for use with the mounds of FIGS. 1F and 1G. For an on-field third base side bullpen mound, the right side piece coupling mechanism 555 would be omitted. For an on-field first base side bullpen mound, the left side piece coupling mechanism 553 would be omitted.

Figure 3I:
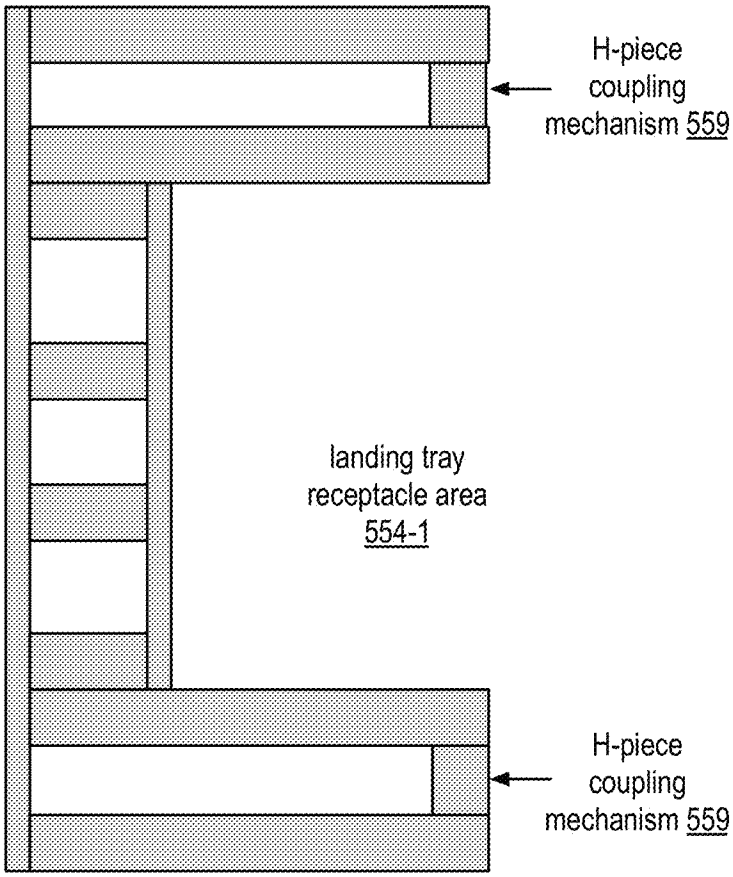
FIGS. 3I-3J are a schematic diagram of an embodiment of a nose piece frame in accordance with the present invention.
Figure 3J:
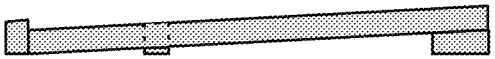

FIGS. 3I-3J are a schematic diagram of an embodiment of a nose piece frame 520-1 that includes a landing tray receptacle area 554-1 and H-piece coupling mechanisms 559. As shown in the side view, the nose piece frame has a slope. The slope corresponds to the slope defined by baseball rules. For example, the slope for professional baseball is one inch per foot (4.76 degrees). Accordingly, the slope of the nose piece frame for an adult mound is one inch per foot or 4.76 degrees. As another example, the slope for a youth mound is five-eighths of an inch per foot (approximately 3 degrees). Accordingly, the slope of the nose piece frame for a youth mound is five-eighths of an inch per foot.

The width of the nose piece frame 520-1 corresponds to the width of the base piece 510 and the length of the nose piece frame is determined based on the length of the H-piece and the desired overall length of the sloped section of mound (e.g., the nose piece plus the H-piece). For example, the length of the H-piece frame is sixty inches, and for an adult mound, the desired overall length of the slope section is ninety-six inches, then the length of the nose piece is thirty-six inches. As another example, if the length of the H-piece is forty-eight inches and, for a youth mound, the desired length is eighty-four inches, then the length of the nose piece is thirty-six inches.

The dimensions of the landing tray receptacle area 554-1 are dependent on the size of the landing tray, the length of the H-piece, the distance desired between the drive tray and the landing tray, and desired tolerance to account for variances in the materials and wrapped turf edges. For example, if the landing tray is thirty-six inches wide, the width of the landing tray receptacle area 554-1 will be 36.25 inches to 37.5 inches depending on tolerances and wrapped turf edges. As another example, if the landing tray has a length of forty-eight inches and the desired distance between the drive tray and the landing tray is eighteen inches, then the length of the landing tray receptacle area 554-1 is about eighteen to nineteen inches depending on tolerances and wrapped turf edges.

The support posts as shown in the side view are positioned to provide a stable structure when the nose piece is placed on a relatively flat service. The top portion of the nose piece frame 520-1 supports the surface being placed thereon. For example, if the surface is plywood covered with artificial turf, the plywood is attached (e.g., screwed, nailed, glued, etc.) to the nose piece frame 520-1. Once the plywood is attached, the turf is attached (e.g., glued, stapled, et.) to the plywood. The nose piece frame 520—is applicable for use with the practice mound of FIG. 1B.

Figure 3L:
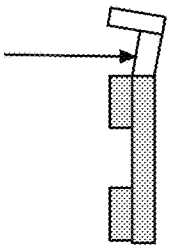
FIGS. 3K-3M are a schematic diagram of another embodiment of a nose piece frame in accordance with the present invention.
Figure 3M:
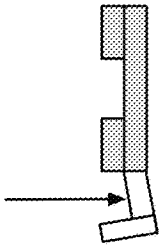
Figure 3K:
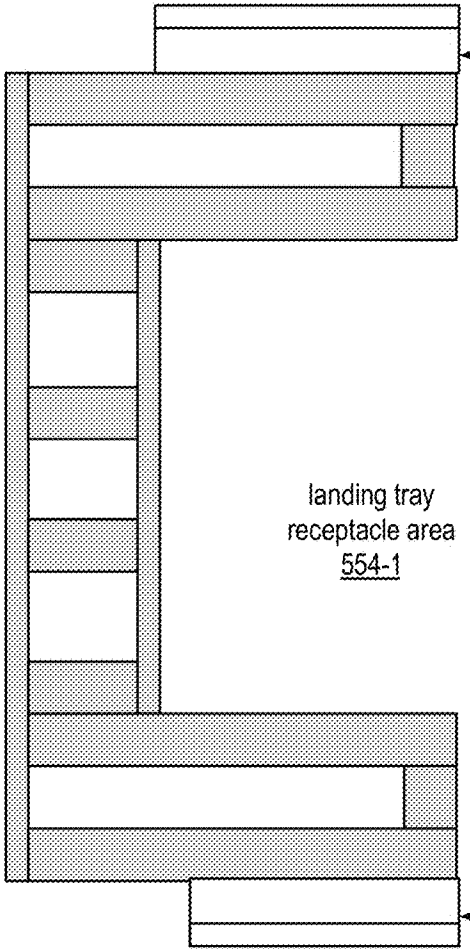

FIGS. 3K-3M are a schematic diagram of another embodiment of a nose piece frame 520-2, which is similar to the nose piece frame 520-1 with the further inclusion of a right front coupling piece 557 and a left front coupling piece 559. The left front coupling mechanism 559 provides a coupling structure to support and connect with the left front piece 514. For example, the left front coupling mechanism 553 includes a support beam that is coupled to the side of the nose piece at an angle and a guide beam coupled to the support beam. The frame of the left front piece 514 is supported by the support beam and held to the nose piece by the guide beam. The right front piece 516 is coupled to the nose piece 520 in a similar manner via the right front coupling mechanism 557.

The nose piece frame 518-2 is applicable for use with the mounds of FIGS. 1A, 1F, and 1G. For the on-field bullpen mound of FIG. 1D, the right side piece coupling mechanism 557 would be omitted. For the on-field bullpen mound of FIG. 1E, the left side piece coupling mechanism 559 would be omitted.

FIGS. 3N-3R are a schematic diagram of an embodiment of a nose piece cap 522-1, which attaches to the nose piece 520. The nose piece cap 522-1 is fabricated to provide a negligible front edge for the various embodiments of the mounds. In many non-clay mounds there is a front edge of an inch or more, which, when a baseball hits it, causes the baseball to reflect in undesired ways. For example, the baseball may bounce back towards the hitter. As another example, the baseball may reflect up into the pitcher's body. With the nose piece cap 522-1, the chances of a baseball bouncing in an undesired way is substantially eliminated.

As shown in the side view, the nose piece cap 522-1 has a flattened "V" shape, where the bottom of the nose piece cap 522-1 is substantially flat or with a slight angle towards the ground. The top side of the nose piece cap 522-1 is angled, which is dependent on its length and the height of the nose piece at the connection point. For example, the length of the nose piece cap may be twelve to fourteen inches and the height of the nose piece at the connection point is 1.5 to 2.5 inches.

Figure 3S:
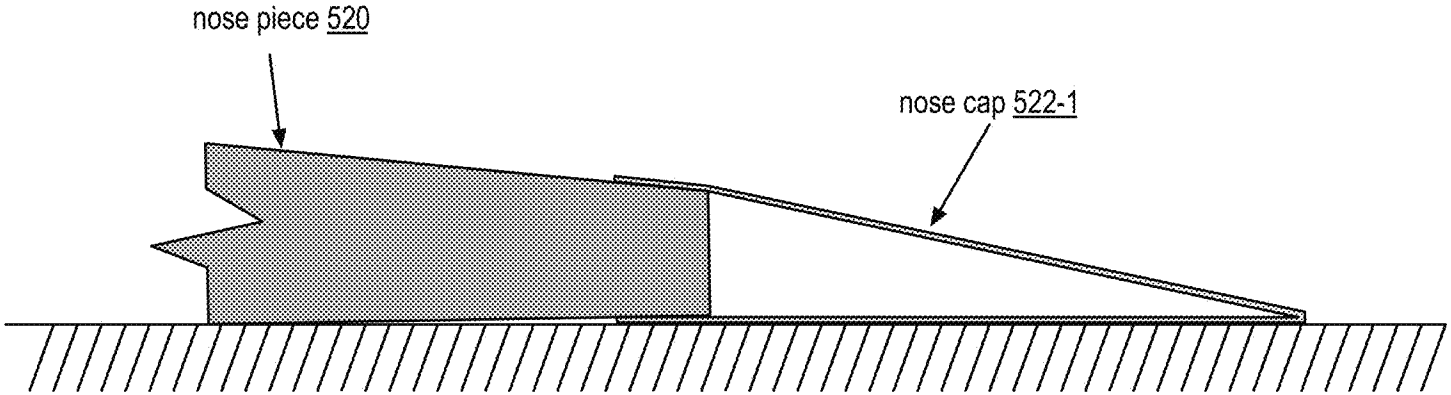
FIG. 3S is a schematic diagram of an example of a nose piece cap in accordance with the present invention.

The top surface of the nose piece cap 522-1 is securely connected (e.g., nailed, stapled, glued, welded, fabricated as part of the nose piece, screwed, bolted, etc.) to the nose piece. The bottom surface of the nose piece cap is secured to the nose piece via screws or bolts through the slots. In this manner, when the nose piece cap makes contact with the ground, it can move slightly via the slot/screw connection allowing it to form a tight connection with the ground (e.g., minimize gaps between the ground and the nose piece cap) as shown in FIG. 3S.

The nose piece cap 522-1 may be fabricated from sheet metal or aluminum. In another embodiment, the nose piece cap may be fabricated from plastic and/or rubber and have a solid inner section.

Figure 3Y:
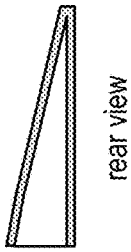
FIGS. 3W-3Y are a schematic diagram of an embodiment of a left nose piece cap in accordance with the present invention.
Figure 3W:
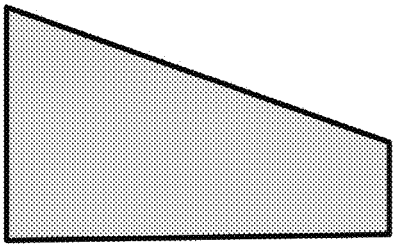
Figure 3X:
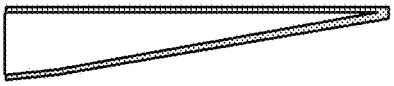
Figure 3V:
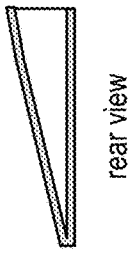
FIGS. 3T-3V are a schematic diagram of an embodiment of a right nose piece cap in accordance with the present invention.
Figure 3T:
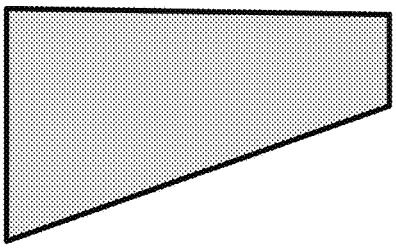
Figure 3U:
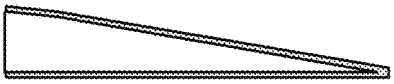

FIGS. 3T-3V are a schematic diagram of an embodiment of a right nose piece cap 522-2, which attaches to the right front piece 516. The right nose piece cap 522-2 is fabricated to provide a negligible front edge for the various embodiments of the mounds. As shown in the side view and in the rear view, the right nose piece cap 522-2 has a flattened "V" shape, where the bottom of the right nose piece cap 522-2 is substantially flat or with a slight angle towards the ground. The top side of the right nose piece cap 522-2 is angled towards the front of the mound and towards the right edge of the mound. The angle of the top surface of the right nose piece cap 522-2 is dependent on its length and width and the height of the right side piece at the connection point. For example, the length of the right nose piece cap is between twelve to fourteen inches, its width is between eight to fourteen inches, and the height of the right side piece at the connection point is 1.5 to 2.5 inches.

The top surface of the right nose piece cap 522-2 is securely connected (e.g., nailed, stapled, glued, welded, fabricated as part of the nose piece, screwed, bolted, etc.) to the right side piece. The bottom surface of the right nose piece cap is secured to the right piece via screws or bolts through slots on the bottom surface. In this manner, when the right nose piece cap makes contact with the ground, it can move slightly via the slot/screw connection allowing it to form a tight connection with the ground.

The right nose piece cap 522-2 may be fabricated from sheet metal or aluminum. In another embodiment, the nose piece cap may be fabricated from plastic and/or rubber and have a solid inner section.

FIGS. 3W-3Y are a schematic diagram of an embodiment of a left nose piece cap 522-3, which attaches to the left front piece 514. The left nose piece cap 522-3 is fabricated to provide a negligible front edge for the various embodiments of the mounds. As shown in the side view and in the rear view, the left nose piece cap 522-3 has a flattened "V" shape, where the bottom of the left nose piece cap 522-3 substantially flat or with a slight angle towards the ground. The top side of the left nose piece cap 522-3 is angled towards the front of the mound and towards the left edge of the mound. The angle of the top surface of the left nose piece cap 522-3 is dependent on its length and width and the height of the right side piece at the connection point. For example, the length of the left nose piece cap 522-3 is between twelve to fourteen inches, its width is between eight to fourteen inches, and the height of the left side piece at the connection point is 1.5 to 2.5 inches.

The top surface of the left nose piece cap 522-3 is securely connected (e.g., nailed, stapled, glued, welded, fabricated as part of the nose piece, screwed, bolted, etc.) to the left side piece. The bottom surface of the left nose piece cap 522-3 is secured to the left side piece via screws or bolts through slots on the bottom surface. In this manner, when the left nose piece cap 522-3 makes contact with the ground, it can move slightly via the slot/screw connection allowing it to form a tight connection with the ground.

The left nose piece cap 522-3 may be fabricated from sheet metal or aluminum. In another embodiment, the nose piece cap may be fabricated from plastic and/or rubber and have a solid inner section.

In a further embodiment, the nose cap pieces 522-1, 522-2, and 522-3 may include interconnecting mechanisms to secure them together. In another embodiment, the nose cap pieces 522-1, 522-2, and 522-3 may be on fabricated as a single piece coupled to the nose piece has have slots for receiving the left and right side pieces 514 and 516.

FIGS. 4A-4C are a schematic diagram of an embodiment of a drive tray 524-1 (e.g., the removable drive area) that includes a drive tray frame 560, a drive tray backing 562, and a pitching rubber support 564. The drive tray frame 560, from a side perspective, has a first section corresponding to a level portion of the modular level and sloped section of the mound (e.g., the base piece 510) and a second section corresponding to a portion of a sloped portion of the modular level and sloped section (e.g., the H-piece 518). The drive tray backing 562 is coupled to the frame 560 to form a tray fill area 566 that is fillable with pitching mound clay. Note that the backing 562 may be coupled to the frame 560 in a variety of ways. For example, they may be coupled via one or more of: being nailed, being stapled, being glued, being welded, being fabricated as an integrated piece, being screwed, and being bolted.

The pitching rubber support 564 is positioned within the drive tray such that is front edge is six inches from the start of the sloped section. The length and width of the pitching rubber support 564 corresponds to the width and length of a pitching rubber (e.g., 24 by 6 inches for an adult pitching rubber and 18×4 inches for a youth pitching rubber). The height of the pitching rubber support 564 corresponds to a difference between the height of the drive tray and the height of the pitching mound rubber. In one embodiment for an adult mound, the drive tray 524-1 has a width of thirty-six inches, a length of twenty-two inches, a height of two and one-half inches at the level area, and a height of one and one-half inches at the front edge of the tray.

Figure 4F:
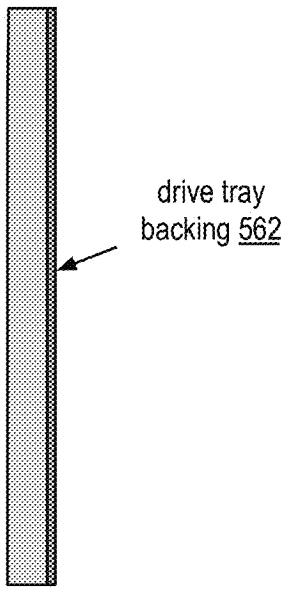
FIGS. 4D-4F are a schematic diagram of another embodiment of a drive tray in accordance with the present invention.
Figure 4D:
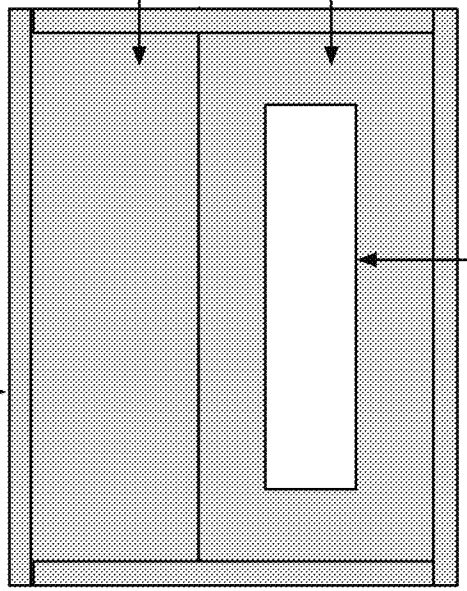
Figure 4E:
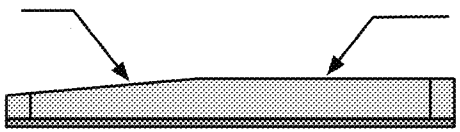

FIGS. 4D-4F are a schematic diagram of another embodiment of a drive tray 524-2 that includes the drive tray frame 560, the drive tray backing 562, and the pitching rubber support 564. In this embodiment, the frame 560 includes a solid fill area 568, which may be fabricated from wood, rubber, plastic, metal, aluminum, etc. In one embodiment, the surface of the solid fill area 568 is covered with an artificial turf, leaving the pitching rubber 18 exposed. Note that, from the side perspective, the solid fill area 568 has a first profile corresponding to the first section of the frame (e.g., the level section) and a second profile corresponding to the second section of the frame (e.g., the sloped section). In an embodiment, the drive tray 524-2 has the same dimensions as the drive tray 524-1, which makes them interchangeable.

Figure 4I:
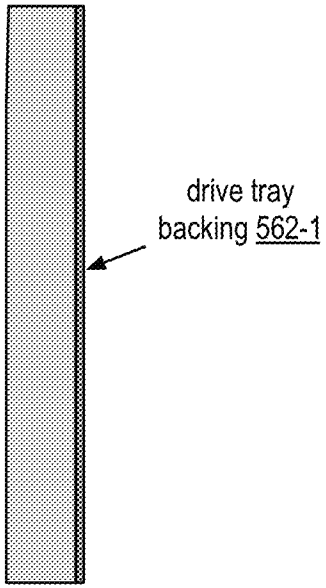
FIGS. 4G-4I are a schematic diagram of another embodiment of a drive tray in accordance with the present invention.
Figure 4G:
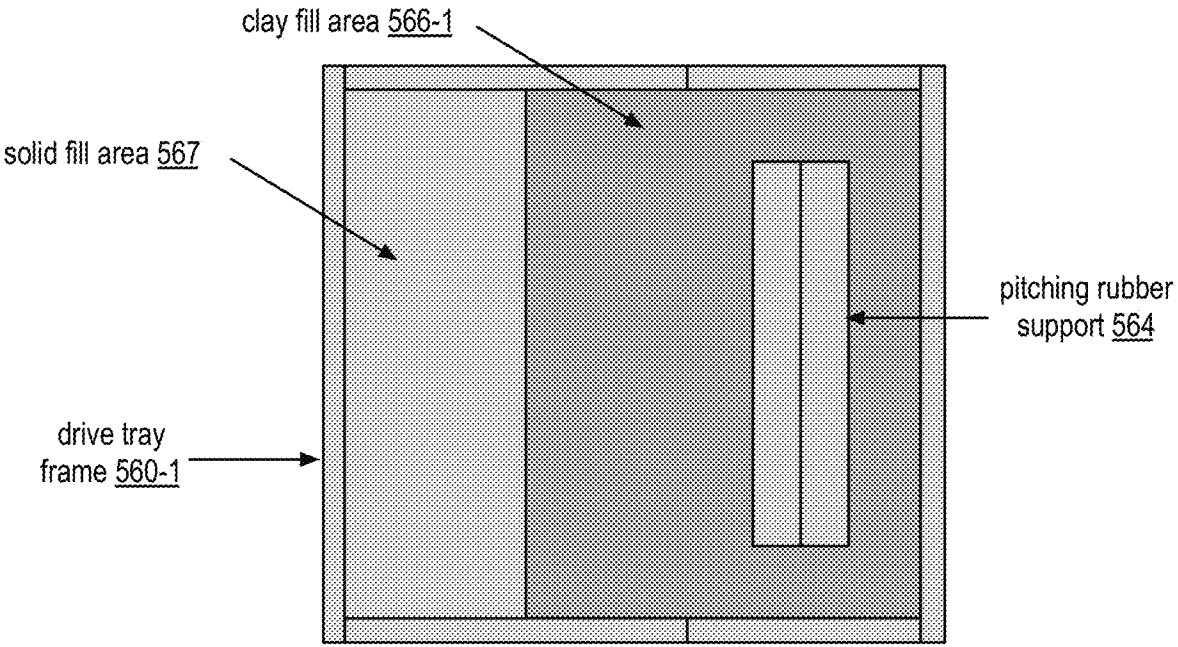
Figure 4H:
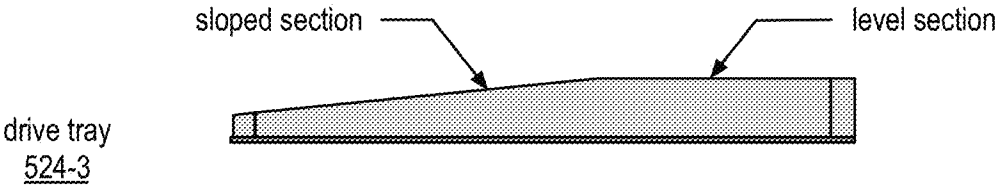

FIGS. 4G-4I are a schematic diagram of another embodiment of a drive tray 524-3 that includes a drive tray frame 560-1, a drive tray backing 562-1, and a pitching rubber support 564. The drive tray frame 560-1, from a side perspective, has a first section corresponding to a level portion of the modular level and sloped section of the mound (e.g., the base piece 510) and a second section corresponding to a portion of a sloped portion of the modular level and sloped section (e.g., the H-piece 518). The drive tray backing 562-1 is coupled to the frame 560-1 to form a tray fill area 566-1 that is fillable with pitching mound clay and a solid fill area 567. Note that the backing 562-1 may be coupled to the frame 560-1 in a variety of ways. For example, they may be coupled via one or more of: being nailed, being stapled, being glued, being welded, being fabricated as an integrated piece, being screwed, and being bolted.

In one embodiment for an adult mound, the drive tray 524-1 has a width of thirty-six inches, a length of thirty-four inches, a height of three and one-half inches at the level area, and a height of one and one-half inches at the front edge of the tray. The solid fill area 567, which may be fabricated from wood, rubber, plastic, metal, aluminum, etc., has a length between ten and fourteen inches. In comparison with the drive tray 522-1 of FIGS. 4A-4C, which has a volume of approximately 0.6 cubic feet, this drive tray has a volume of approximately 1.7 cubic feet. If the entire volume of drive tray 524-3 were filled with pitching mound clay, it would weight approximately 180 pounds (e.g., 170 pounds for the clay and 10 pounds for the tray). By including the solid fill area 567, less clay is required, thereby reducing the overall weight of the tray 524-3.

Figure 4L:
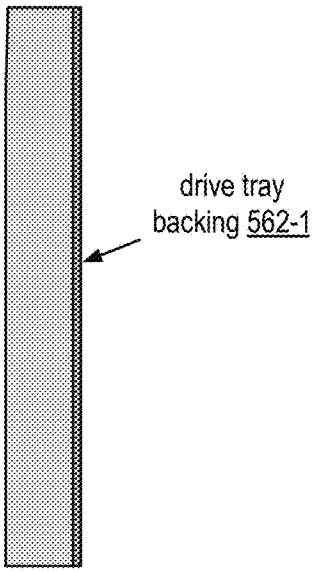
FIGS. 4J-4L are a schematic diagram of another embodiment of a drive tray in accordance with the present invention.
Figure 4J:
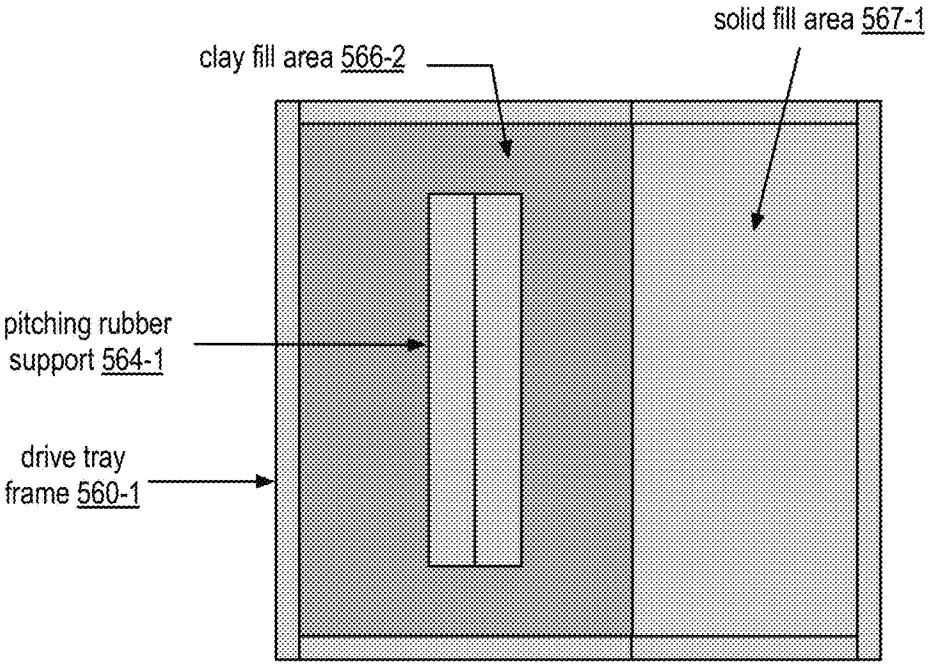
Figure 4K:
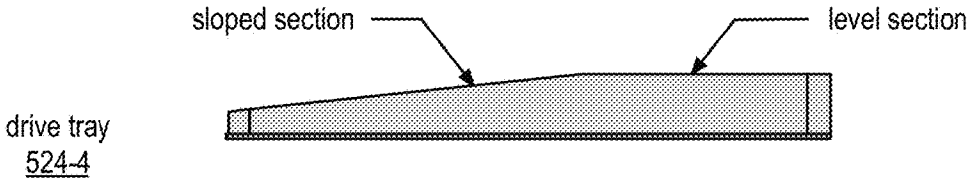

FIGS. 4J-4L are a schematic diagram of another embodiment of a drive tray 524-4 that includes the drive tray frame 560-1, the drive tray backing 562-1, and the pitching rubber support 564-1. The drive tray frame 560-1, from a side perspective, has a first section corresponding to a level portion of the modular level and sloped section of the mound (e.g., the base piece 510) and a second section corresponding to a portion of a sloped portion of the modular level and sloped section (e.g., the H-piece 518). The drive tray backing 562-1 is coupled to the frame 560-1 to form a tray fill area 566-2 that is fillable with pitching mound clay and a solid fill area 567-1

In an embodiment, the drive tray 524-4 has the same overall dimensions as drive tray 524-3, which makes the interchangeable. In drive tray 524-4, the solid fill area 567-1 is in the level section of the drive tray and the pitching rubber support 564-1 in the sloped section of the drive tray. With the pitching rubber in this position, the stride length to the landing tray is shortened by 10 to 14 inches in comparison to the stride length for drive trays 524-1 and 524-3.

Figure 5C:
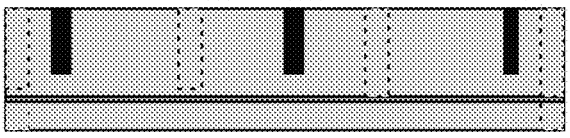
FIGS. 5A-5C are a schematic diagram of an embodiment of a landing tray in accordance with the present invention.
Figure 5A:
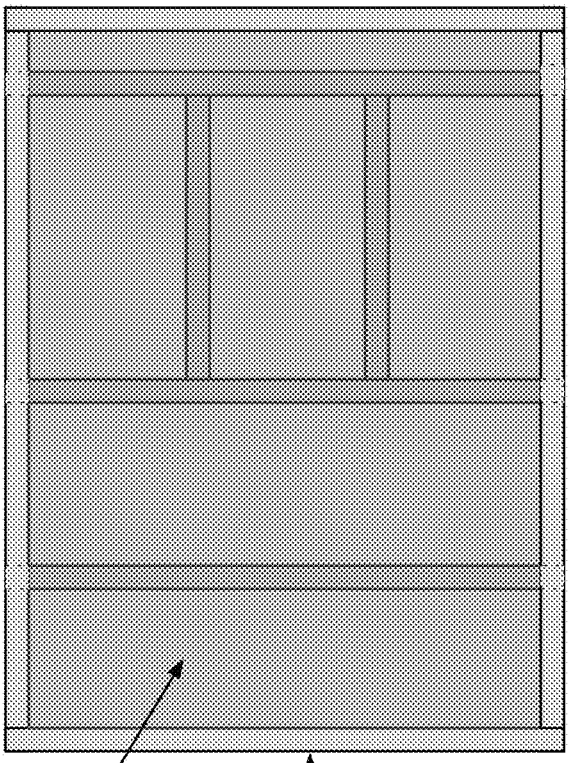
Figure 5B:
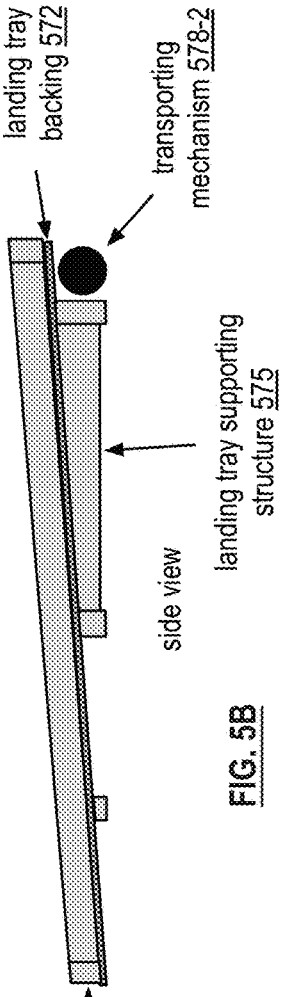

FIGS. 5A-5C are a schematic diagram of an embodiment of a landing tray 526-1 that includes a landing tray frame 570, a landing tray backing 572, a landing tray supporting structure 575, and transporting mechanisms 578-1 and 578-2. From a side perspective, the frame 570 has a slope corresponding to a portion of a sloped portion of the modular level and sloped section (e.g., of the H-piece 518). The landing tray backing 572 is coupled to the frame 570 to form a tray fill area 574 that is fillable with pitching mound clay. Note that the backing 572 may be coupled to the frame 570 in a variety of ways. For example, they may be coupled via one or more of: being nailed, being stapled, being glued, being welded, being fabricated as an integrated piece, being screwed, and being bolted.

The supporting structure 575 is mechanically coupled to the backing 572 and/or to the frame 570. The supporting structure 575 provides a platform that rests on the ground when the landing tray 526-1 is installed in one of the mounds. For a three foot by four foot by two inch deep landing tray, the supporting structure 575 supports 2 cubic feet of clay (i.e., approximately 200 pounds of clay).

The transporting mechanisms 578-1 and 578-2 are coupled to the frame 570 and function to assist with installation, alignment, securing, and removal of the removable landing tray (e.g., the removable landing area). In an embodiment, the transporting mechanism 578-1 includes one or more handles coupled to a first end of the removable landing tray (e.g., the font end of the tray, which is towards the front of the mound). The transporting mechanism 578-2 includes one or more wheels coupled to a second end of the removable landing tray (e.g., the back end of the landing tray). In an alternate embodiment, the transporting mechanism 578-1 includes one or more straps coupled to at least one of the backing and the frame towards the first end of the removable landing area. In another alternate embodiment, the transporting mechanism 578-1 includes one or more notches cut into a first end of the removable landing tray.

Figure 5F:
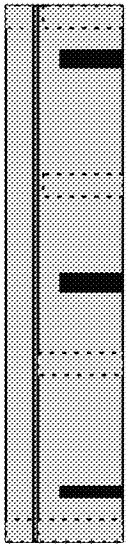
FIGS. 5D-5F are a schematic diagram of another embodiment of a landing tray in accordance with the present invention.
Figure 5D:
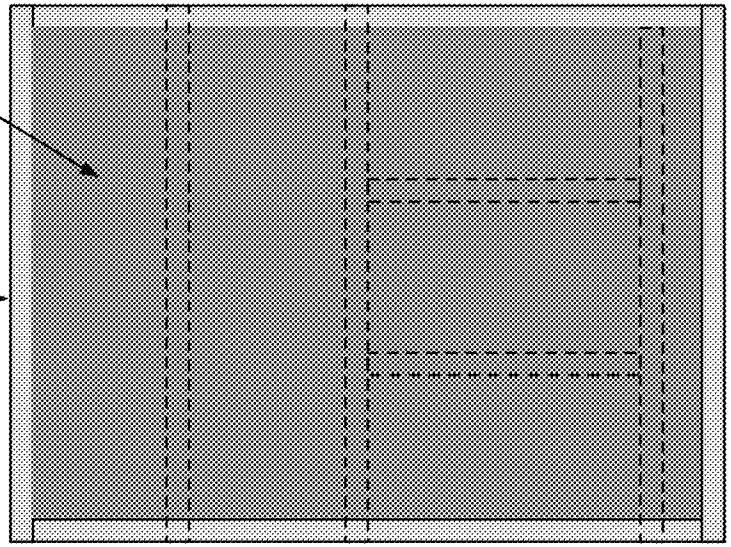
Figure 5E:
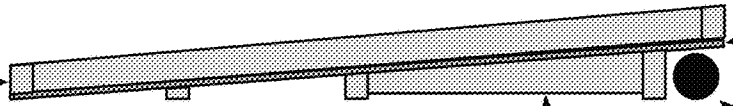

FIGS. 5D-5F are a schematic diagram of another embodiment of a landing tray 526-2 that includes the landing tray frame 570, the landing tray backing 572, the landing tray supporting structure 575, and the transporting mechanisms 578-1 and 578-2. In this embodiment, the frame 570 and backing 572 support a solid fill area 580, which may be fabricated from wood, rubber, plastic, metal, aluminum, etc. In one embodiment, the surface of the solid fill area 580 is covered with an artificial turf. Note that, from the side perspective, the solid fill area 568 has a first profile corresponding to the slope of the frame 570. In an embodiment, the landing tray 524-2 has the same dimensions as the landing tray 524-1, which makes them interchangeable.

FIGS. 6A-6B are a schematic diagram of an embodiment of a rear piece 502 that includes a rear frame 600 and a rear surface 602. The rear frame 600 includes a supporting structure for mechanical coupling to the rear surface 602. In an example embodiment, the supporting structure (e.g., the vertical pieces in the top view of the figure) is fabricated from wood and the rear surface is plywood with an artificial turf attached to the plywood.

The rear frame 600 further includes a mechanically coupling beam (e.g., the horizontal piece in the top view of the figure), which mechanically couples to the rear piece coupling mechanism 547 of the base piece 510. The side view illustrates that the rear coupling mechanism 547 supports the rear piece 502 and keeps it aligned with the base piece. Note that if the rear piece 502 and the base piece 510 each are surfaced with artificial turf that wraps around the edges, the artificial turf on the edges acts a securing mechanism when the rear piece is placed in the rear piece coupling mechanism 547.

Figures 6C, 6D, 6E:
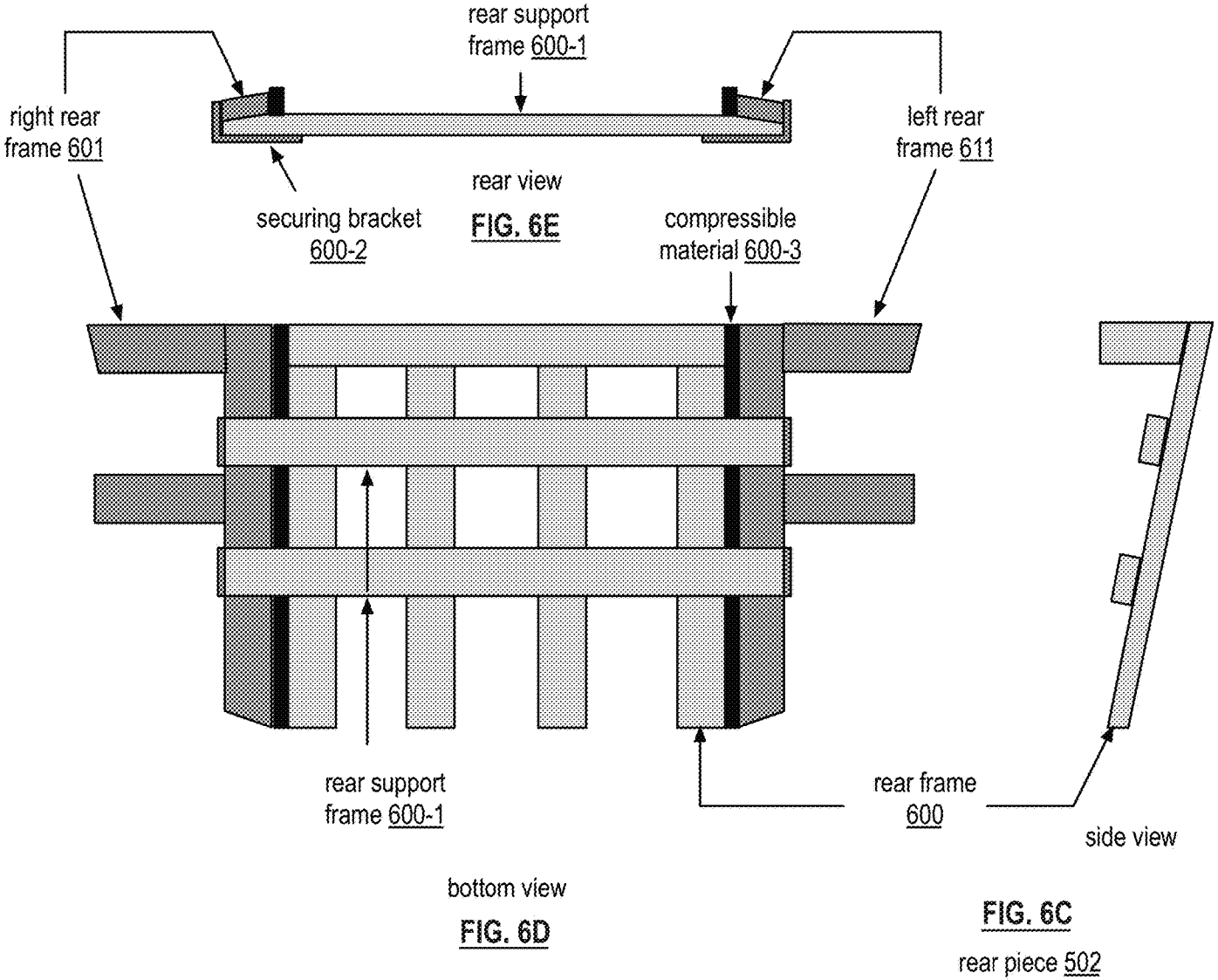
FIGS. 6C-6E are a schematic diagram of another embodiment of a rear piece in accordance with the present invention.

FIGS. 6C-6D are a schematic diagram of another embodiment of a rear piece 502 that includes the frame 600 and a rear support frame 600-1. From a bottom view, the rear support frame 600-1 is mechanically coupled to the frame 600 and includes securing brackets 600-2. The ends of the pieces of the support frame 600-1 are angled to provide an angled support platform for the right rear frame 601 of the right rear piece 506 and for the left rear frame 611 of the left rear piece 504. The angle is dependent on the height of the base piece 510 and the length of the left and right pieces 508 and 512.

A compressible material 600-3 is placed between the rear frame 600 and the frames 601 and 611 for the right and left side pieces. The compressible material 600-3 (e.g., rubber, silicon, foam, artificial turf, etc.), allows for a press fit of the left and right side pieces with the rear piece. Accordingly, as the frames of the left and right side pieces are coupling to the rear support frame and brackets, the compressible material is compressing to provide a compression fit.

FIG. 7A-7B are a schematic diagram of an embodiment of a right side piece 512 that includes a right side frame 604 and a right side surface 606. The right side frame 604 includes a supporting structure for mechanical coupling to the right side surface 606. In an example embodiment, the supporting structure (e.g., the vertical pieces in the top view of the figure) is fabricated from wood and the right side surface is plywood with an artificial turf attached to the plywood.

The right side frame 604 further includes a mechanically coupling beam (e.g., the horizontal piece in the top view of the figure), which mechanically couples to the right side piece coupling mechanism 549 of the base piece 510. The side view illustrates that the right side coupling mechanism 549 supports the right side piece 512 and keeps it aligned with the base piece. Note that if the right side piece 512 and the base piece 510 each are surfaced with artificial turf that wraps around the edges, the artificial turf on the edges acts a securing mechanism (e.g., a compressible material) when the right side piece is placed in the right side piece coupling mechanism 549.

Figures 7C, 7D, 7E:
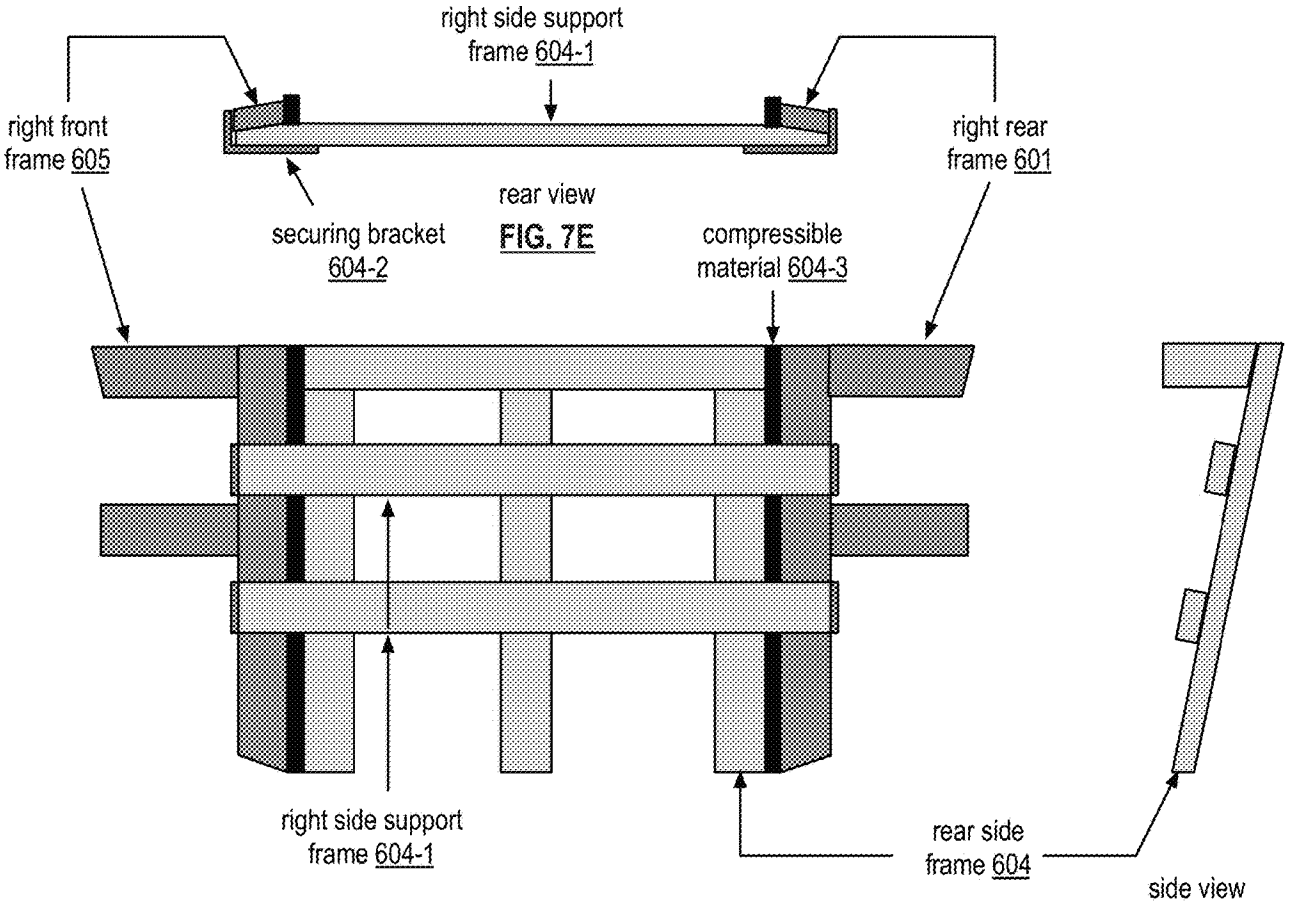
FIGS. 7C-7E are a schematic diagram of another embodiment of a right side piece in accordance with the present invention.

FIGS. 7C-7E are a schematic diagram of another embodiment of a right side piece 512 that includes the frame 604 and a right side support frame 604-1. From a bottom view, the right side support frame 604-1 is mechanically coupled to the frame 604 and includes securing brackets 604-2. The ends of the pieces of the support frame 604-1 are angled to provide an angled support platform for the right rear frame 601 of the right rear piece 506 and for the right front frame 605 of the right front piece 516. The angle for is dependent on the height of the base piece 510 and the length of the right front and rear pieces 506 and 516.

A compressible material 604-3 is placed between the right side frame 604 and the frames 601 and 605 for the right rear and front pieces. The compressible material 604-3 (e.g., rubber, silicon, foam, artificial turf, etc.), allows for a press fit of the right rear and front pieces with the right side piece. Accordingly, as the frames of the right rear and front pieces are coupling to the right side support frame and brackets, the compressible material is compressing to provide a compression fit.

Figure 7F:
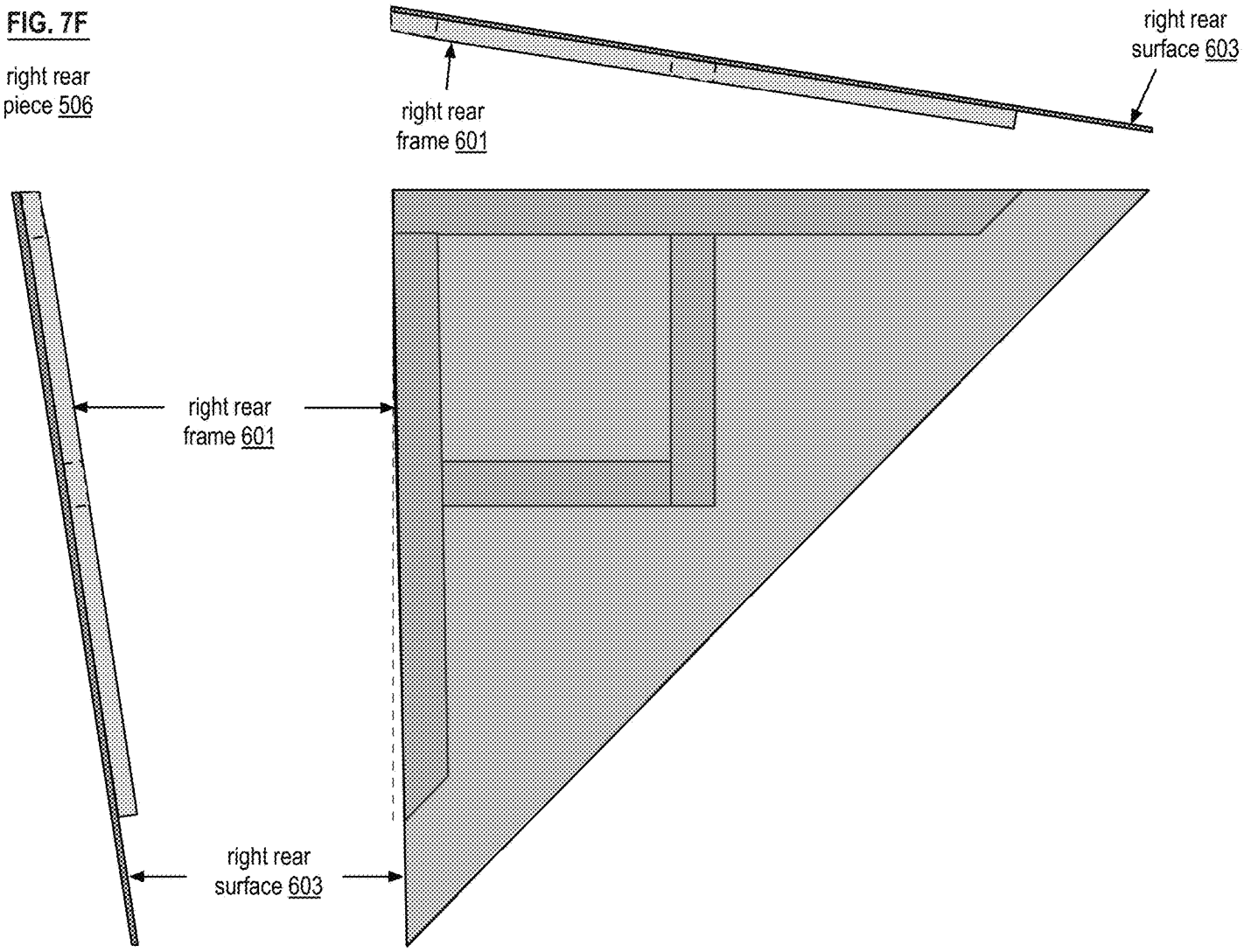
FIG. 7F is a schematic diagram of an embodiment of a right rear piece in accordance with the present invention.

FIG. 7F is a schematic diagram of an embodiment of a right rear piece 506 that includes a right rear frame 601 and a right rear surface 603. The right rear frame 601 includes a supporting structure for mechanical coupling to the right rear surface 603. In an example embodiment, the supporting structure (e.g., the darker shaded pieces in the top view of the figure) is fabricated from wood and the right rear surface is plywood with an artificial turf attached to the plywood. The outer pieces of the right rear frame 601 (e.g., along the top and left side of the top view) mechanically couple to the right side piece coupling mechanism 549 of the base piece 510.

Figure 7G:
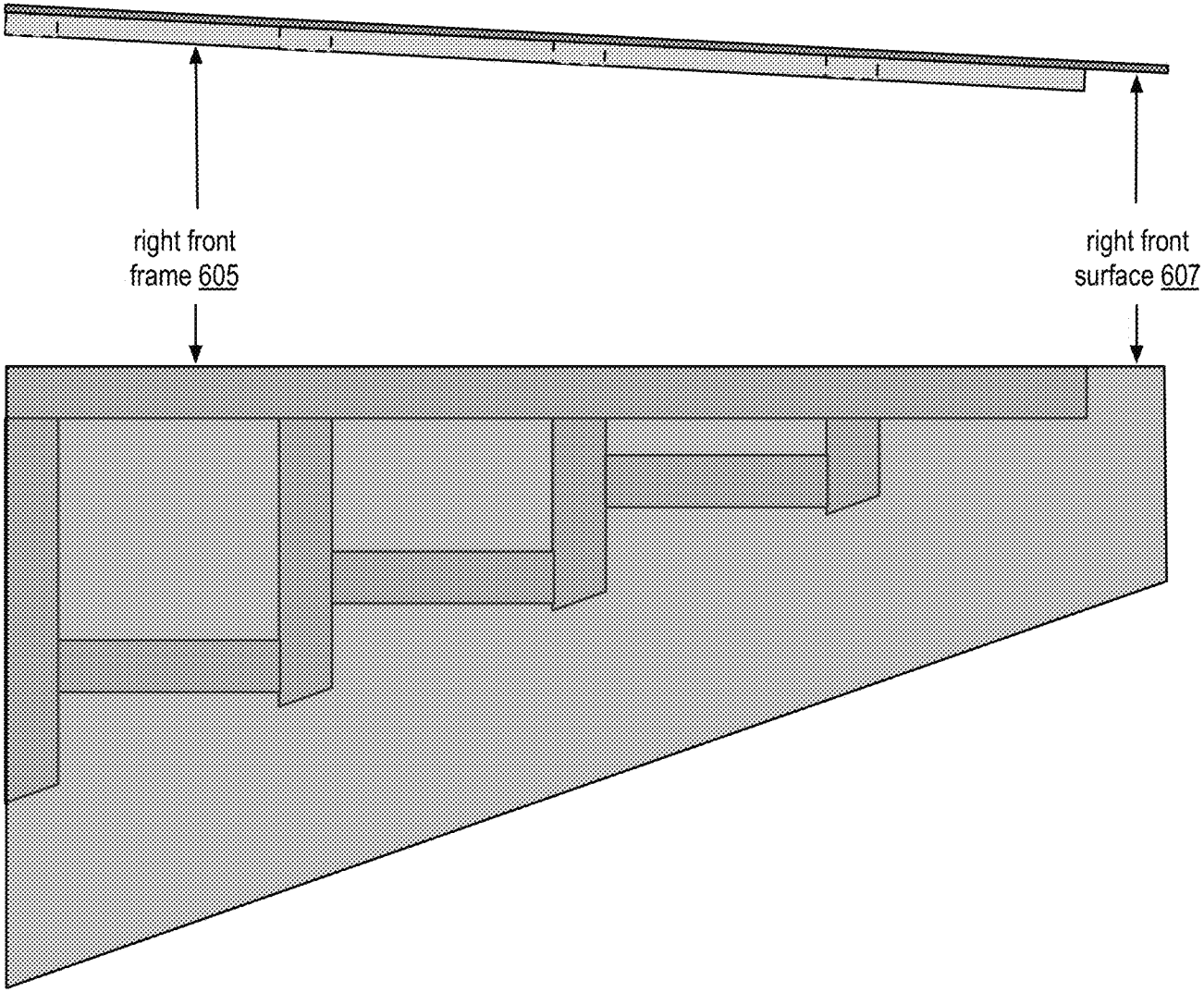
FIG. 7G is a schematic diagram of an embodiment of a right front piece in accordance with the present invention.

FIG. 7G is a schematic diagram of an embodiment of a right front piece 516, which may include one or two pieces. The right front piece 516 includes a right front frame 605 and a right front surface 607. The right front frame 605 includes a supporting structure for mechanical coupling to the right front surface 607. In an example embodiment, the supporting structure (e.g., the darker shaded pieces in the top view of the figure) is fabricated from wood and the right front surface is plywood with an artificial turf attached to the plywood. The outer pieces of the right front frame 605 (e.g., along the top and left side of the top view) mechanically couple to the right front piece coupling mechanism 555 of the H-piece 518.

Figure 8A:
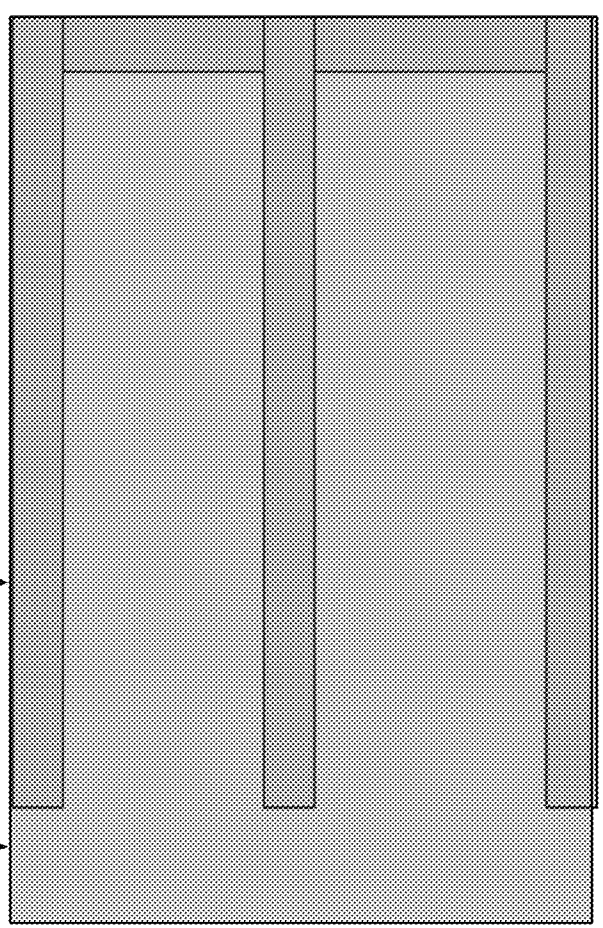
FIGS. 8A-8B are a schematic diagram of an embodiment of a left side piece in accordance with the present invention.
Figure 8B:
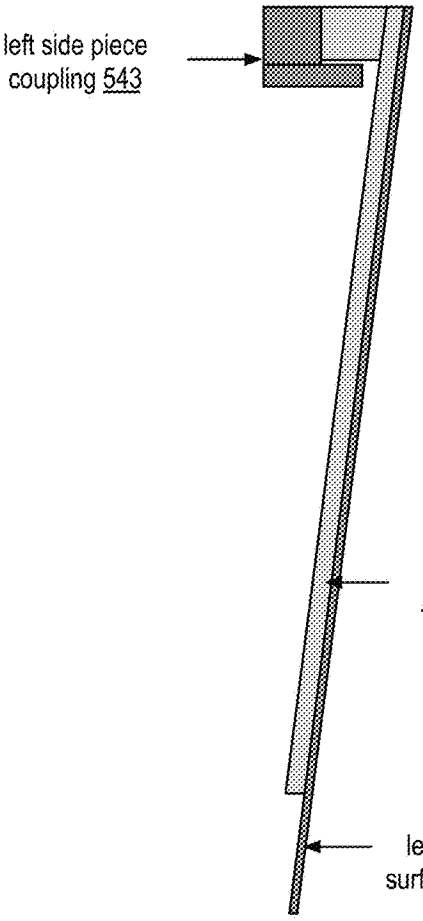

FIGS. 8A-8B are a schematic diagram of an embodiment of a left side piece 508 that includes a left side frame 608 and a left side surface 610. The left side frame 608 includes a supporting structure for mechanical coupling to the left side surface 610. In an example embodiment, the supporting structure (e.g., the vertical pieces in the top view of the figure) is fabricated from wood and the right side surface is plywood with an artificial turf attached to the plywood.

The left side frame 608 further includes a mechanically coupling beam (e.g., the horizontal piece in the top view of the figure), which mechanically couples to the left side piece coupling mechanism 543 of the base piece 510. The side view illustrates that the left side coupling mechanism 543 supports the left side piece 508 and keeps it aligned with the base piece. Note that if the left side piece 508 and the base piece 510 each are surfaced with artificial turf that wraps around the edges, the artificial turf on the edges acts a securing mechanism (e.g., a compressible material) when the right side piece is placed in the left side piece coupling mechanism 543.

Figures 8C, 8D, 8E:
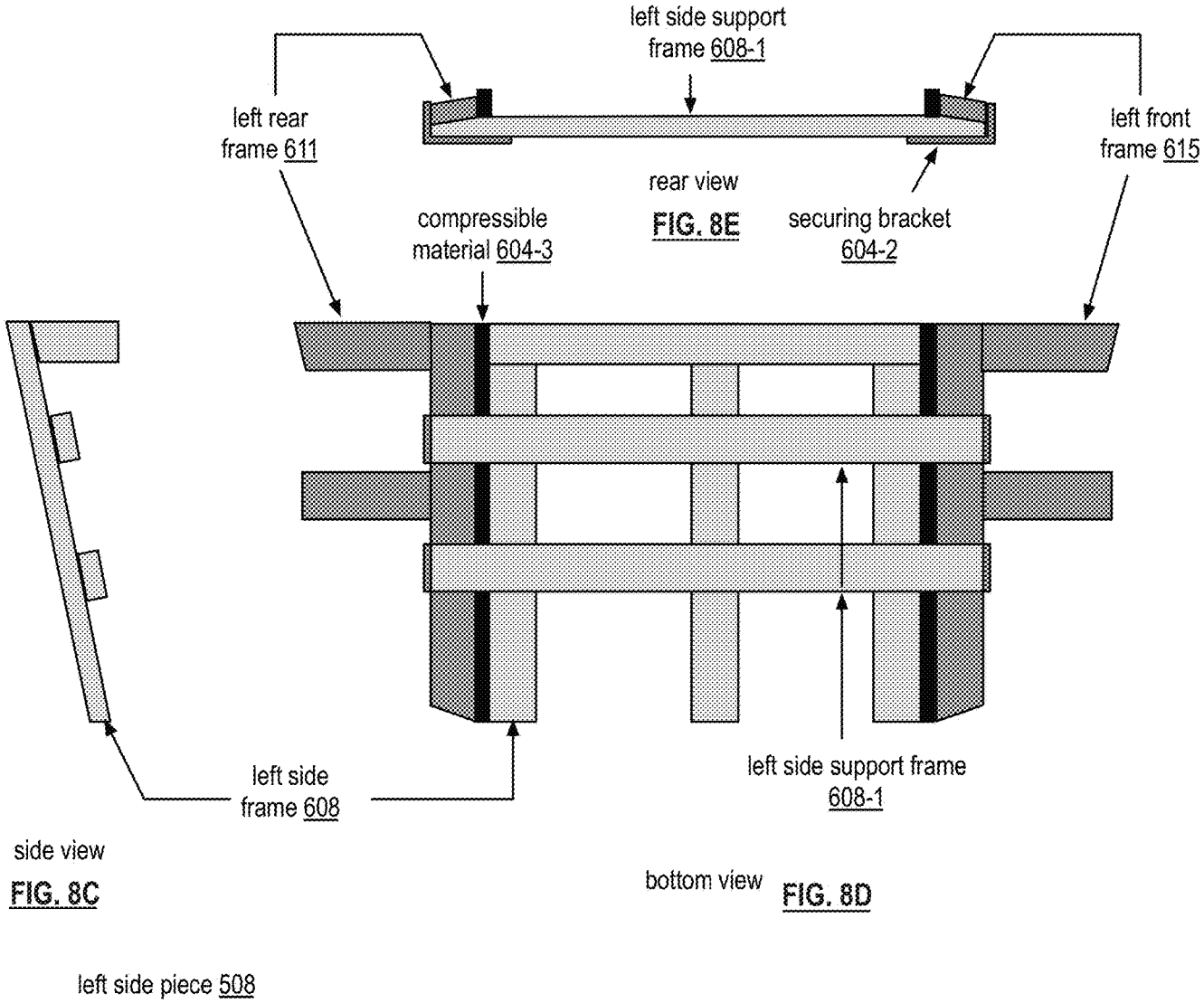
FIGS. 8C-8E are a schematic diagram of another embodiment of a left side piece in accordance with the present invention.

FIGS. 8C-8E are a schematic diagram of another embodiment of a left side piece 508 that includes the frame 608 and a left side support frame 608-1. From a bottom view, the left side support frame 608-1 is mechanically coupled to the frame 608 and includes securing brackets 604-2. The ends of the pieces of the support frame 608-1 are angled to provide an angled support platform for the left rear frame 611 of the left rear piece 504 and for the left front frame 615 of the left front piece 514. The angle for is dependent on the height of the base piece 510 and the length of the left front and rear pieces 504 and 514.

A compressible material 604-3 is placed between the left side frame 608 and the frames 611 and 615 for the left rear and front pieces. The compressible material 604-3 (e.g., rubber, silicon, foam, artificial turf, etc.), allows for a press fit of the left rear and front pieces with the left side piece. Accordingly, as the frames of the left rear and front pieces are coupling to the left side support frame and brackets, the compressible material is compressing to provide a compression fit.

Figure 8F:
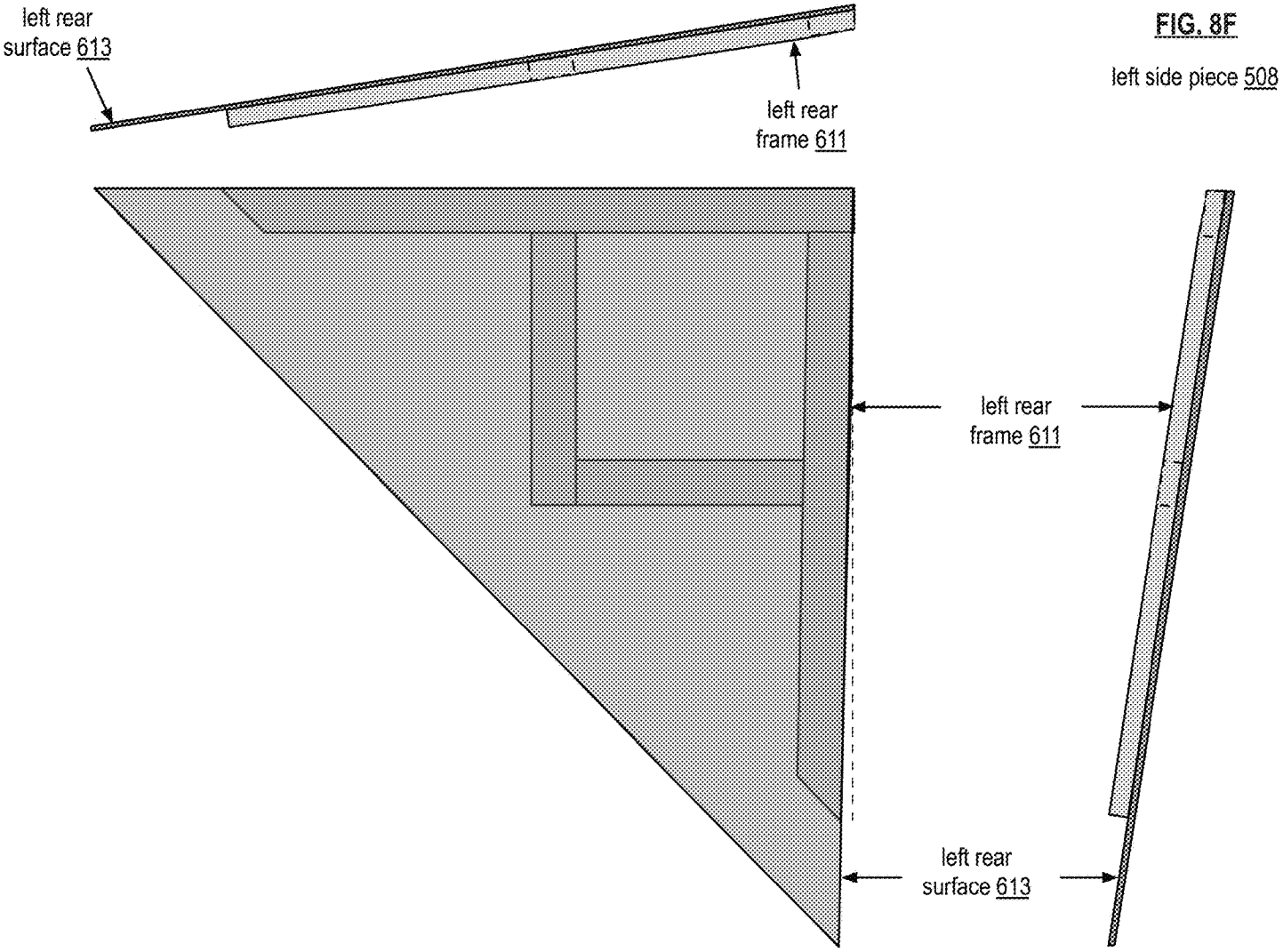
FIG. 8F is a schematic diagram of an embodiment of a left rear piece in accordance with the present invention.

FIG. 8F is a schematic diagram of an embodiment of a left rear piece 504 that includes a left rear frame 611 and a left rear surface 613. The left rear frame 611 includes a supporting structure for mechanical coupling to the left rear surface 613. In an example embodiment, the supporting structure (e.g., the darker shaded pieces in the top view of the figure) is fabricated from wood and the left rear surface is plywood with an artificial turf attached to it. The outer pieces of the left rear frame 611 (e.g., along the top and right side of the top view) mechanically couple to the left side piece coupling mechanism 543 of the base piece 510.

Figure 8G:
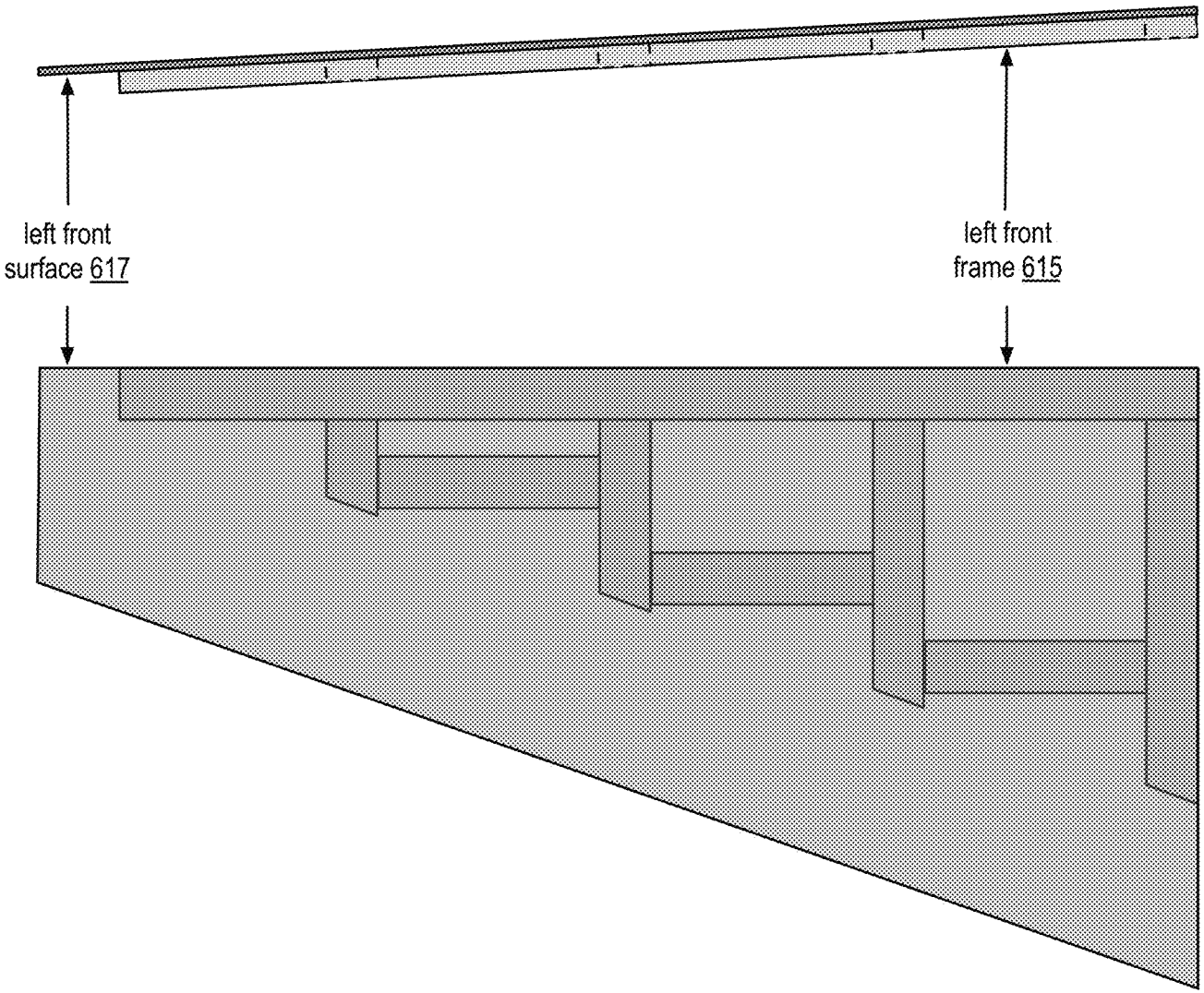
FIG. 8G is a schematic diagram of an embodiment of a left front piece in accordance with the present invention.

FIG. 8G is a schematic diagram of an embodiment of a left front piece 514, which may include one or two pieces. The left front piece 514 includes a left front frame 615 and a left front surface 617. The left front frame 615 includes a supporting structure for mechanical coupling to the left front surface 617. In an example embodiment, the supporting structure (e.g., the darker shaded pieces in the top view of the figure) is fabricated from wood and the left front surface is plywood with an artificial turf attached to it. The outer pieces of the left front frame 615 (e.g., along the top and right side of the top view) mechanically couple to the left front piece coupling mechanism 553 of the H-piece 518.

Each of the various mounds described herein are dimensioned in accordance with rules for youth baseball and/or in accordance with rules adult baseball. Per professional baseball rules, a mound is specified to be ten inches high; have a slope of one inch per foot starting six inches in front of the pitching rubber; the pitching rubber is set back twelve inches from the center of the mound; and have a diameter of eighteen feet. Per youth baseball rules, a mound is specified to be six inches high and have a diameter of twelve feet. In the various mound embodiments described herein, the height, slope, and positioning of the rubber have been strictly adhered to, while the overall dimension has been approximated.

It is noted that terminologies as may be used herein such as bit stream, stream, signal sequence, etc. (or their equivalents) have been used interchangeably to describe digital information whose content corresponds to any of a number of desired types (e.g., data, video, speech, audio, etc. any of which may generally be referred to as 'data').

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "configured to", "operably coupled to", "coupled to", and/or "coupling" includes direct coupling between items and/or indirect coupling between items via an intervening item (e.g., an item includes, but is not limited to, a component, an element, a circuit, and/or a module) where, for an example of indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "configured to", "operable to", "coupled to", or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item.

As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1. As may be used herein, the term "compares unfavorably", indicates that a comparison between two or more items, signals, etc., fails to provide the desired relationship.

As may also be used herein, the terms "processing module", "processing circuit", "processor", and/or "processing unit" may be a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions. The processing module, module, processing circuit, and/or processing unit may be, or further include, memory and/or an integrated memory element, which may be a single memory device, a plurality of memory devices, and/or embedded circuitry of another processing module, module, processing circuit, and/or processing unit. Such a memory device may be a read-only memory, random access memory, volatile memory, non-volatile memory, static memory, dynamic memory, flash memory, cache memory, and/or any device that stores digital information. Note that if the processing module, module, processing circuit, and/or processing unit includes more than one processing device, the processing devices may be centrally located (e.g., directly coupled together via a wired and/or wireless bus structure) or may be distributedly located (e.g., cloud computing via indirect coupling via a local area network and/or a wide area network). Further note that if the processing module, module, processing circuit, and/or processing unit implements one or more of its functions via a state machine, analog circuitry, digital circuitry, and/or logic circuitry, the memory and/or memory element storing the corresponding operational instructions may be embedded within, or external to, the circuitry comprising the state machine, analog circuitry, digital circuitry, and/or logic circuitry. Still further note that, the memory element may store, and the processing module, module, processing circuit, and/or processing unit executes, hard coded and/or operational instructions corresponding to at least some of the steps and/or functions illustrated in one or more of the Figures. Such a memory device or memory element can be included in an article of manufacture.

One or more embodiments have been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claims. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality.

To the extent used, the flow diagram block boundaries and sequence could have been defined otherwise and still perform the certain significant functionality. Such alternate definitions of both functional building blocks and flow diagram blocks and sequences are thus within the scope and spirit of the claims. One of average skill in the art will also recognize that the functional building blocks, and other illustrative blocks, modules and components herein, can be implemented as illustrated or by discrete components, application specific integrated circuits, processors executing appropriate software and the like or any combination thereof.

In addition, a flow diagram may include a "start" and/or "continue" indication. The "start" and "continue" indications reflect that the steps presented can optionally be incorporated in or otherwise used in conjunction with other routines. In this context, "start" indicates the beginning of the first step presented and may be preceded by other activities not specifically shown. Further, the "continue" indication reflects that the steps presented may be performed multiple times and/or may be succeeded by other activities not specifically shown. Further, while a flow diagram indicates a particular ordering of steps, other orderings are likewise possible provided that the principles of causality are maintained.

The one or more embodiments are used herein to illustrate one or more aspects, one or more features, one or more concepts, and/or one or more examples. A physical embodiment of an apparatus, an article of manufacture, a machine, and/or of a process may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

Unless specifically stated to the contra, signals to, from, and/or between elements in a figure of any of the figures presented herein may be analog or digital, continuous time or discrete time, and single-ended or differential. For instance, if a signal path is shown as a single-ended path, it also represents a differential signal path. Similarly, if a signal path is shown as a differential path, it also represents a single-ended signal path. While one or more particular architectures are described herein, other architectures can likewise be implemented that use one or more data buses not expressly shown, direct connectivity between elements, and/or indirect coupling between other elements as recognized by one of average skill in the art.

The term "module" is used in the description of one or more of the embodiments. A module implements one or more functions via a device such as a processor or other processing device or other hardware that may include or operate in association with a memory that stores operational instructions. A module may operate independently and/or in conjunction with software and/or firmware. As also used herein, a module may contain one or more sub-modules, each of which may be one or more modules.

As may further be used herein, a computer readable memory includes one or more memory elements. A memory element may be a separate memory device, multiple memory devices, or a set of memory locations within a memory device. Such a memory device may be a read-only memory, random access memory, volatile memory, non-volatile memory, static memory, dynamic memory, flash memory, cache memory, and/or any device that stores digital information. The memory device may be in a form a solid state memory, a hard drive memory, cloud memory, thumb drive, server memory, computing device memory, and/or other physical medium for storing digital information.

While particular combinations of various functions and features of the one or more embodiments have been expressly described herein, other combinations of these features and functions are likewise possible. The present disclosure is not limited by the particular examples disclosed herein and expressly incorporates these other combinations.

What is claimed is:

1. A bullpen mound comprises:

a first mound section that includes:

a first base piece;

a first H-piece that couples to the first base piece, wherein the first base piece and the first H-piece, when coupled together, form a first drive tray recepticle;

a first nose piece that couples to the first H-piece, wherein the first H-piece and the first nose piece, when coupled together, form a first landing tray opening;

a first drive tray that couples to the first drive tray receptacle; and a first landing tray that resides in the first landing tray opening;

a second mound section that includes:

a second base piece;

a second H-piece that couples to the second base piece, wherein the second base piece and the second H-piece, when coupled together, form a second drive tray recepticle;

a second nose piece that couples to the second H-piece, wherein the second H-piece and the second nose piece, when coupled together, form a second landing tray opening;

a second drive tray that couples to the second drive tray receptacle; and a second landing tray that resides in the second landing tray opening; and a bridge section that resides between the first and second mound section when the bullpen mound is assembled.

2. The bullpen mound of claim 1, wherein the bridge section comprises:

a bridge base piece that corresponds to the first and second bases;

a first bridge sloped piece that corresponds to the first and second H-pieces and couples to the bridge base; and a second bridge sloped piece that correspond to the first and second nose pieces and couples to the first bridge sloped piece.

3. The bullpen mound of claim 1, wherein the first base piece comprises:

a lower base outer frame;

a lower base tray support coupled to the lower base outer frame, wherein the lower base tray support provides a portion of the first drive tray receptacle; and upper base frame coupled to the lower base outer frame.

4. The bullpen mound of claim 3, wherein the lower base outer frame comprises:

a first H-alignment section;

a second H-alignment section;

alignment posts; and a frame coupled to the first H-alignment section, the second H-alignment section, and the alignment posts.

5. The bullpen mound of claim 1, wherein the first H-piece comprises:

first and second nose piece coupling mechanisms;

first and second base piece coupling mechanisms; support posts; and an H-frame coupled to the first and second nose piece coupling mechanisms, the first and second base piece coupling mechanisms, and the support posts.

6. The bullpen mound of claim 1, wherein the first nose piece comprises:

first and second H-piece coupling mechanisms; and a frame coupled to the first and second H-piece coupling mechanisms.

* * * * *